United States Patent [19]

Weinerman et al.

[11] Patent Number: 5,046,340

[45] **Date of Patent: * Sep. 10, 1991**

[54] LATCH AND LOCK ASSEMBLIES WITH SPRING-BIASED PIVOT BOLTS

[75] Inventors: Lee S. Weinerman, Medina; David F. Worden, Brookpark, both of Ohio; Norman Lauterbach, Ormond Beach, Fla.; Wilton T. Farmer, Jr., Mechanicsville, Va.

[73] Assignee: The Eastern Company, Cleveland, Ohio

[ * ] Notice: The portion of the term of this patent subsequent to Nov. 13, 2007 has been disclaimed.

[21] Appl. No.: 554,331

[22] Filed: Jul. 17, 1990

Related U.S. Application Data

[63] Continuation-in-part of Ser. No. 327,545, Mar. 23, 1989, Pat. No. 4,969,916, which is a continuation-in-part of Ser. No. 72,174, Jul. 10, 1987, Pat. No. 4,850,208, which is a continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[5] ..... E05B 13/10

[52] U.S. Cl. ..... 70/208; 70/210; 70/83; 292/227; 292/DIG. 31

[58] Field of Search ..... 70/208, 431, 466, 483–485, 70/489, 81, 83, 84; 292/198, 210, 224, 227, 240–242, 228, 164, DIG. 31, DIG. 37, DIG. 63

[56] References Cited

U.S. PATENT DOCUMENTS

| | | | |
|---|---|---|---|
| Re. 14,741 | 10/1919 | Anderson | 292/198 |
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| D. 302,239 | 7/1989 | Russell et al. | D8/366 |
| D. 303,350 | 9/1989 | Russell et al. | D8/343 |
| D. 303,351 | 9/1989 | Weinerman et al. | D8/344 |
| D. 303,617 | 9/1989 | Russell et al. | D8/306 |
| D. 303,618 | 9/1989 | Russell et al. | D8/306 |
| D. 303,619 | 9/1989 | Russell et al. | D8/313 |
| D. 303,620 | 9/1989 | Russell et al. | D8/313 |
| D. 303,621 | 9/1989 | Russell et al. | D8/313 |
| D. 303,754 | 10/1989 | Weinerman et al. | D8/344 |
| D. 303,922 | 10/1989 | Russell et al. | D8/321 |
| D. 304,155 | 10/1989 | Russell et al. | D8/303 |
| D. 308,010 | 5/1990 | Russell et al. | D8/343 |
| 791,258 | 5/1905 | Ford | 411/130 |
| 824,330 | 6/1906 | Barnard | 411/131 |
| 1,995,106 | 3/1935 | Roedding | 292/226 |

(List continued on next page.)

OTHER PUBLICATIONS

Southco Inc., Southco Fasteners Handbook 37, Concordville, Pa., 19331.

(List continued on next page.)

*Primary Examiner*—Gary L. Smith
*Assistant Examiner*—Suzanne L. Dino
*Attorney, Agent, or Firm*—David A. Burge

[57] ABSTRACT

Flush mountable latches and locks for industrial cabinets, tool carts, electrical equipment enclosures and the like utilize versatile housings together with a variety of types of handles that are movable relative to the housings to effect unlatching movements of spring-biased, pivotally mounted latch bolts, with pivotally mounted operating arms serving to drivingly interconnect the handles with the latch bolts. Lockable embodiments have locking mechanisms that prevent operating movements of the operating arms, but do not prevent pivotal movement of the latch bolts out of their latched positions, whereby even the lockable embodiments have latch bolts that can be "slammed" into latching engagement with suitably configured strike formations. Other improvement features reside in the provision of coaxially-pivoted overlying sets of latch bolt and operating arm components that cooperate in a plurality of ways, and in the provision of stop formations, torsion-spring-receiving formations, and co-acting drive formations, with such features enabling the resulting latch and lock assemblies to employ a small number of relatively movable parts that can be assembled, installed and serviced with ease.

28 Claims, 15 Drawing Sheets

U.S. PATENT DOCUMENTS

| | | | |
|---|---|---|---|
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 3/1955 | Tatom | 16/147 |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,773,376 | 12/1956 | Wartian | 70/150 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,872,241 | 2/1959 | Shelden | 296/65 |
| 2,900,204 | 8/1959 | Pelcin | 292/173 |
| 2,916,905 | 12/1959 | Podlesak | 70/150 |
| 2,924,478 | 2/1960 | Wartian | 292/224 |
| 2,952,150 | 9/1960 | Matzkin et al. | 70/451 |
| 2,962,320 | 11/1960 | Gilbert | 292/337 |
| 2,987,908 | 6/1961 | Pelcin | 70/146 |
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/140 |
| 3,161,923 | 12/1964 | Crain | 20/52 |
| 3,190,334 | 6/1965 | Wigam | 411/131 |
| 3,208,781 | 9/1965 | Appleberry | 292/128 |
| 3,209,563 | 10/1965 | Pelcin | 70/146 |
| 3,209,564 | 10/1965 | Pelcin | 70/148 |
| 3,240,523 | 3/1966 | Heimann | 292/198 |
| 3,338,610 | 8/1967 | Pelcin et al. | 292/126 |
| 3,351,116 | 1/1967 | Madsen | 411/131 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/336.3 |
| 3,550,412 | 12/1970 | Pitel et al. | 70/461 |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,767,244 | 10/1973 | Plaw | 292/227 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 296/137 |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 70/472 |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,365,831 | 12/1982 | Bourne | 292/229 |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 244/75 |
| 4,492,394 | 1/1985 | Dignan | 292/64 |
| 4,496,261 | 1/1985 | Cohen et al. | 411/368 |
| 4,498,319 | 2/1985 | Balducci et al. | 70/92 |
| 4,510,779 | 3/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 70/169 |
| 4,679,835 | 7/1987 | Weinerman et al. | 292/197 |
| 4,683,736 | 8/1987 | Weinerman et al. | 70/208 |
| 4,684,281 | 8/1987 | Patterson | 411/129 |
| 4,693,503 | 9/1987 | Bisbing | 292/210 |
| 4,706,478 | 11/1987 | Swan et al. | 70/208 |
| 4,707,006 | 11/1987 | Garg et al. | 292/336.3 |
| 4,838,054 | 6/1989 | Weinerman et al. | 70/208 |
| 4,838,056 | 6/1989 | Weinerman et al. | 70/208 |
| 4,841,755 | 6/1989 | Weinerman et al. | 70/208 |
| 4,850,208 | 7/1989 | Weinerman et al. | 70/208 |
| 4,850,209 | 7/1989 | Weinerman et al. | 70/208 |
| 4,911,487 | 3/1990 | Rachocki | 70/208 X |

OTHER PUBLICATIONS

Eberhard Manufacturing Co., Handbook of Latches, Locks, Hinges, Handles, and Related Hardward, No. 103, Cleveland, Ohio 44136, 1985.

Adams Rite Manufacturing Co., *Hardware for Glass Doors That Swing or Slide,* City of Industry , Calif. 91749, Jan. 1988.

LATCH AND LOCK ASSEMBLIES WITH SPRING-BIASED PIVOT BOLTS

CROSS-REFERENCE TO RELATED APPLICATIONS

The present application is a continuation-in-part of co-pending application entitled LATCH AND LOCK ASSEMBLIES WITH SPRING-BIASED PIVOT BOLTS, Ser. No. 327,545 filed Mar. 23, 1989 by Lee S. Weinerman et al (referred to hereinafter either as the "Presently Pending Parent Case" or as "Utility Case III(b)") issued as U.S. Pat. No. 4,969,916, which application was filed as a continuation-in-part of a prior application entitled LATCH AND LOCK ASSEMBLIES WITH SPRING-BIASED PIVOT BOLTS, Ser. No. 072,174 filed July 10, 1987 by Lee S. Weinerman et al (referred to hereinafter either as the "Parent Case" or as "Utility Case III(a)") issued July 25, 1989 as U.S. Pat. No. 4,850,208, which prior application was filed as a continuation-in-part of an earlier application entitled CABINET LOCK WITH RECESSED HANDLE, Ser. No. 859,194 filed Apr. 28, 1986 by Lee S. Weinerman et al that issued Aug. 4, 1987 as U.S. Pat. No. 4,683,736, which earlier application was filed as a continuation-in-part of another earlier application Ser. No. 601,648 filed Apr. 18, 1984 (now abandoned), with said earlier applications being referred to hereinafter as the "Predecessor Cases," and with the disclosures of all of the Parent Cases and the Predecessor Cases being incorporated herein by reference.

REFERENCE TO OTHER RELEVANT APPLICATIONS AND PATENTS

At the time that the Parent Case (as identified above) was filed, several "companion" applications also were filed that relate to other concurrently developed aspects of a long term and continuing program of development that gave rise to the invention of the Parent Case. The list that follows identifies not only the "companion" applications that were filed and the patents that have issued therefrom, but also such divisional and continuation-in-part applications that have been filed together with such patents as have issued therefrom. The disclosures of the several patents and applications that are listed below are incorporated herein by reference, namely:

LATCH AND LOCK HOUSINGS, HANDLES AND MOUNTING BRACKETS, U.S. Pat. No. 4,850,209 Issued July 25, 1989 from application Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

LATCH AND LOCK ASSEMBLIES WITH SPRING-BIASED SLIDE BOLTS, U.S. Pat. No. 4,841,755 Issued June 27, 1989 from application Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

LATCH AND LOCK ASSEMBLIES WITH LIFT AND TURN HANDLES, U.S. Pat. No. 4,838,054 Issued June 13, 1989 from application Ser. No. 072,175, filed July 10, 1987 by Lee S. Weinerman, Frank R. Albris, Thomas V. McLinden and Timothy H. Wentzell, hereinafter referred to as the "Utility Case IV;"

LATCH AND LOCK ASSEMBLIES WITH EXPANSIBLE LATCH ELEMENTS, U.S. Pat. No. 4,838,056 Issued June 13, 1989 from application Ser. No. 072,250, filed July 10, 1987 by Lee S. Weinerman, Steven A. Mayo, Thomas V. McLinden and Timothy H. Wentzell, hereinafter referred to as the "Utility Case V;"

HOUSINGS FOR LATCHES AND LOCKS, U.S. Pat. No. Des. 303,922 Issued Oct. 10, 1989 from application Ser. No. 072,282 filed July 10, 1987 by Richard H. Russell David W. Kaiser and Richard M. O'Grady, hereinafter referred to as the "Design Case I(a)," a divisional application entitled HOUSING FOR LATCHES AND LOCKS, Ser. No. 383,983 having been filed July 24, 1989, hereinafter referred to as the "Design Case I(b);"

FLUSH MOUNTED LATCH ASSEMBLY, U.S. Pat. No. Des. 303,619 Issued Sept. 26, 1989 from application Ser. No. 072,283, filed July 10, 1987 by Richard H. Russell, David W. Kaiser and Richard M. O'Grady, hereinafter referred to as the "Design Case II;"

FLUSH MOUNTED LATCH ASSEMBLY, U.S. Pat. No. Des. 303,621 Issued Sept. 26, 1989 from application Ser. No. 072,285, filed July 10, 1987 by Richard H. Russell and David W. Kaiser, hereinafter referred to as the "Design Case III;"

FLUSH MOUNTED LATCH ASSEMBLY, U.S. Pat. No. Des. 303,620 Issued Sept. 26, 1989 from application Ser. No. 072,284, filed July 10, 1987 by Richard H. Russell and David W. Kaiser, hereinafter referred to as the "Design Case IV;"

FLUSH MOUNTED LATCH ASSEMBLY, U.S. Pat. No. Des. 304,155 Issued Oct. 24, 1989 from application Ser. No. 072,276, filed July 10, 1987 by Richard H. Russell and David W. Kaiser, hereinafter referred to as the "Design Case V;"

FLUSH MOUNTED LATCH ASSEMBLY, U.S. Pat. No. Des. 303,617 Issued Sept. 26, 1989, from application Ser. No 072,573, filed July 10, 1987 by Richard H. Russell and David W. Kaiser, hereinafter referred to as the "Design Case VI;"

COMBINED HOUSINGS AND HANDLES FOR LATCHES AND LOCKS, U.S. Pat. No. Des. 303,618 Issued Sept. 26, 1989 from application Ser. No. 072,277, filed July 10, 1987 by Richard H. Russell and David W. Kaiser, hereinafter referred to as the "Design Case VII;"

MOUNTING BRACKETS FOR LATCHES AND LOCKS, U.S. Pat. No. Des. 303,350 Issued Sept. 12, 1989 from application Ser. No. 072,278, filed July 10, 1987 by Richard H. Russell and Thomas V. McLinden, hereinafter referred to as the "Design Case VIII(a)" a division of which issued May 22, 1990 as U.S. Pat. No. Des. 308,010 from application Ser. No. 372,945 having been filed June 28, 1989, hereinafter referred to as the "Design Case VIII(b);"

MOUNTING BRACKETS FOR A FLUSH-MOUNTED LATCH ASSEMBLY, U.S. Pat. No. Des. 302,239 Issued July 18, 1989 from application Ser. No. 072,280, filed July 10, 1987 by Richard H. Russell and Thomas V. McLinden, hereinafter referred to as the "Design Case IX;"

STRIKE PLATE, U.S. Pat. No. Des. 303,351 Issued Sept. 12, 1989 from application Ser. No. 072,279, filed July 10, 1987 by Lee S. Weinerman and Steven A.

Mayo, hereinafter referred to as the "Design Case X;" and,

STRIKE PLATE, U.S. Pat. No. Des. 303,754 Issued Oct. 3, 1989 from application Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize coaxially-pivoted sets of overlying latch bolt and operating arm components that are of novel form and that cooperate and co-act in a plurality of ways to provide desired types of latching and locking actions.

2. Prior Art

Flush mounted latches and locks that each include a body, a latch bolt movably carried on the body, and an operating handle that is nested by the body are well known. Normally the handle is in a flush or nested position when the bolt is in a latched position; and unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pat. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to the Eastern Company, a corporation of Connecticut.

Flush mounted latches and locks having latch bolts of other than the spring-projected, slide-mounted type are disclosed in such U.S. Pat. Nos. as 4,413,849, 4,320,642, 4,312,203, 4,134,281, 3,857,594, 3,338,610, 3,044,814, 3,044,287 and 2,735,706, all of which are assigned to the Eastern Company.

Latches having spring-biased pivotally-mounted latch bolts with hook-shaped arm portions projecting sidewardly from housings that enclose associated operating components, with the arm portions being "slammable" into latching engagement with suitably configured striker formations are disclosed in U.S. Pat. No. 4,511,166 assigned to the Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

3. Cross-Referenced & Referenced Patents & Applications

The present invention, taken together with the inventions that form the subjects matter of a select group of the cross-referenced and referenced utility and design patents and applications, require special comment inasmuch as these several inventions represent the work products of a long term and continuing development program. The group includes such cross-referenced and referenced cases as involve applications that either were put on file on July 10, 1987, or were filed as divisions or continuations of applications that were put on file on July 10, 1987. Thus the select group is comprised of cases that all relate back to cases that were filed July 10, 1987; and, the present case is appropriate to include within the select group inasmuch as it is a continuation-in-part of one of the cases of the select group, namely a case that was filed as a continuation-in-part of one of a total of sixteen applications that were put on file on July 10, 1987.

With respect to the cases of the select group, it should be understood that there are clear lines of demarcation among the subjects matter of each of these cases. The several functional features that form the subjects matter of the utility cases, and the several appearance features that form the subjects matter of the design cases, were developed by various co-workers, as is reflected in the listing of inventors in these cases. Many of the functional and appearance features that are claimed in separate ones of the utility and design cases developed substantially concurrently, especially as regards the subjects matter of the several companion cases that were put on file on July 10, 1987.

If an invention feature that is disclosed in one of the select group of utility and design cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several other utility and design cases of the select group. No two of these cases include claims of identical scope.

Referenced Utility Cases III(a) and III(b) disclose combinations of housing and handle assemblies that use spring-biased latch bolts that are pivotally mounted, with the latch bolts being configured and arranged so as to provide "slam-capable" latch and lock units—however, these units are not well suited for use on sliding doors, which is the principal application for latches and locks of the type that embody features of the present invention. Referenced Utility Case II, namely U.S. Pat. No. 4,841,755, discloses housing and handle combinations of the general type that preferably are utilized in latch and lock units that include features of the present invention. Design Cases I(a) and I(b), namely U.S. Pat. No. Des. 303,922 and co-pending divisional application Ser. No. 383,983, relate to appearance features of housings of said general type. Design Cases II, IV and VII, namely U.S. Pat. Nos. Des. 303,619, 303,618 and 303,620, respectively, relate to appearance features of housing and handle combinations that are of said general type. Design Cases VIII(a) and VIII(b), namely U.S. Pat. Nos. Des. 303,350 and 308,010, relate to appearance features of mounting brackets of the general type that can be used to mount latch and lock assemblies that embody the preferred practice of the present invention on closures of the type that are provided with openings that closely receive central body portions of said housings. Others of the cases of the select group disclose subjects matter that are believed to be of less relevance to features of the present invention.

SUMMARY OF THE INVENTION

The present invention provides novel and improved, flush mountable latches and locks for industrial cabinets, tool carts, electrical equipment enclosures and the like. More particularly, the present invention relates to novel and improved latches and locks that are particularly well suited to use handle and housing combinations of the general type that are disclosed in U.S. Pat. No. 4,841,755; that are intended to provide "slam-capable" latches and locks as by providing sidewardly-projecting, pivotally-mounted latch bolts that have hook-shaped latching formations of the general type that are disclosed in U.S. Pat. No. 4,511,166; and that include improvement features that reside in the utilization of sets of overlying operating arm and latch bolt components that are coaxially but independently pivoted, and that are drivingly connected 1) so that movement of each handle from its normal position to its operating position will cause corresponding pivotal movements both a) of the associated operating arm to its operating position, and b) of the associated latch bolt to its unlatched position, and 2) so as to permit each latch bolt to pivot relative to its associated operating arm so that a hook-shaped portion of the latch bolt can be "slammed" into latching engagement with a suitably configured figured keeper or striker (just as similarly configured hook-shaped latch bolt formations are described in U.S. Pat. No. 4,511,166 as being capable of functioning).

In accordance with features of the present invention, flush mountable latches and locks are provided for use in conjunction with industrial cabinets, tool carts, electrical equipment enclosures and the like. The latches and locks preferably utilize versatile housings that can nest and movably mount a variety of operating handles, with the most preferred forms of the handle and housing components being those that are described and illustrated in U.S. Pat. No. 4,841,755. The handles move relative to the housings to effect unlatching movements of spring-biased, pivotally mounted latch bolts, with pivotally mounted operating arms being provided to serve the primary function of drivingly interconnecting the handles with the latch bolts, but with the operating arms and their associated latch bolts being cooperatively configured so as to permit relative movement to take place between the latch bolts and their associated operating arms (to enable the latch bolts to be "slammed" into latching engagement with suitably configured keepers and striker formations).

A latch or lock that embodies features of the preferred practice of present invention typically is employed as by mounting its housing on a closure (typically as by inserting central body portions of the housing into a passage that is formed through an edge region of the closure, and by clamping other portions of the housing into engagement with portions of the closure that surround the passage), with the closure being of the type that is slidably mounted for movement (i.e., the closure is movable principally in side-to-side directions) relative to an access opening that is to be selectively "closed" by the closure; and, the latch or lock utilizes a paired set of interactive components that are mounted on its housing for independent pivotal movement about a common axis, namely an operating arm and a latch bolt that cooperate not only 1) to provide a driving connection between the operating handle and the latch bolt, but also 2) to assure that, regardless of whether the operating arm is being restrained from moving out of its normal non-operating position, the latch bolt is free to pivot as may be required to enable a hook-shaped portion of the latch bolt to latchingly engage a suitably configured keeper or striker formation as the closure (on which the latch or lock is mounted) is "slammed" closed.

In locking units of the type that embody the preferred practice of the present invention, a locking device is provided that is moveable selectively into and out of the path of movement that is followed by the operating arm in moving from its normal position to its operating position. By this arrangement, movement of the operating arm from its normal position to its operating position is controlled by "locking" and "unlocking" movements of a portion of the locking device selectively into and out of the path of movement of the operating arm (with these "locking" and "unlocking" movements being carried out when the operating arm is in its normal non-operated position). By selectively restraining the movement of the operating arm (while not restraining movement of the associated latch bolt), each such locking unit does nothing to impede such latch bolt movements as are required to permit the latch bolt to latchingly engage a suitably configured keeper or striker—whereby what is referred to in the art as a "slam capability" is imparted even to locking units that embody the preferred practice of the present invention.

Turning more specifically to novel features that are embodied in a set of latch bolt and operating arm components that are utilized in the most preferred practice of the present invention, the latch bolt is an elongate member that has portions that not only extend across the back wall of the recessed portion of the housing but also extend beyond opposite sides of the recessed portion of the housing. Carried on the portions of the latch bolt that extend beyond opposite sides of the recessed portions of the housing are a pair of stop formations, with one of these stop formations being engageable with one side of the recessed portion of the housing, and with the other of these stop formations being engageable with the other side of the recessed portion of the housing. By this arrangement, opposed sides of the recessed portion of the housing are engaged by latch-bolt-carried stops when the latch bolt has reached either of the extreme ranges of its movement, namely it is in its latched position or its unlatched positions. Further, the latch bolt has cut-out portions that define a recess for receiving portions of a torsion coil spring that is interposed between the housing and the latch bolt for biasing the latch bolt toward its latched position.

Still other features reside in the provision of the latch bolt with a relatively large diameter hole that is formed through one end region of the latch bolt. The hole receives and smoothly journals for relative rotation a mounting-sleeve portion of the operating arm so that a secure co-axial, pivotal mounting of these two key components is assured. The operating arm preferably is of generally L-shaped configuration and has one of its legs that closely overlies portions of the latch bolt. The "overlying leg" of the operating arm provides an enlarged formation of material that is interposed between a handle-carried operating formation and portions of the latch bolt to transmit operating force quite directly from the handle-carried operating formation through the enlarged formation of the operating arm to the latch bolt to effect movement of the latch bolt from its latched position to its unlatched position in response to movement of the handle from its normal non-operated position to its operated position. Moreover, the extent to which the operating arm has any "obstructing" portions that align with the path of movement that is followed by the latch bolt in moving between its latched and unlatched positions is limited; indeed, it is limited to the provision of the enlarged formation that is described in the foregoing sentence; and, to assure that the enlarged formation does not impede needed movement of the latch bolt, the enlarged formation normally is positioned by the operating arm so as to be situated at one end of said path of movement whereby it poses no obstacle to such relative movements of the latch bolt and the operating arm as are needed in order to provide latch and lock units of the present invention with a "slam capability."

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
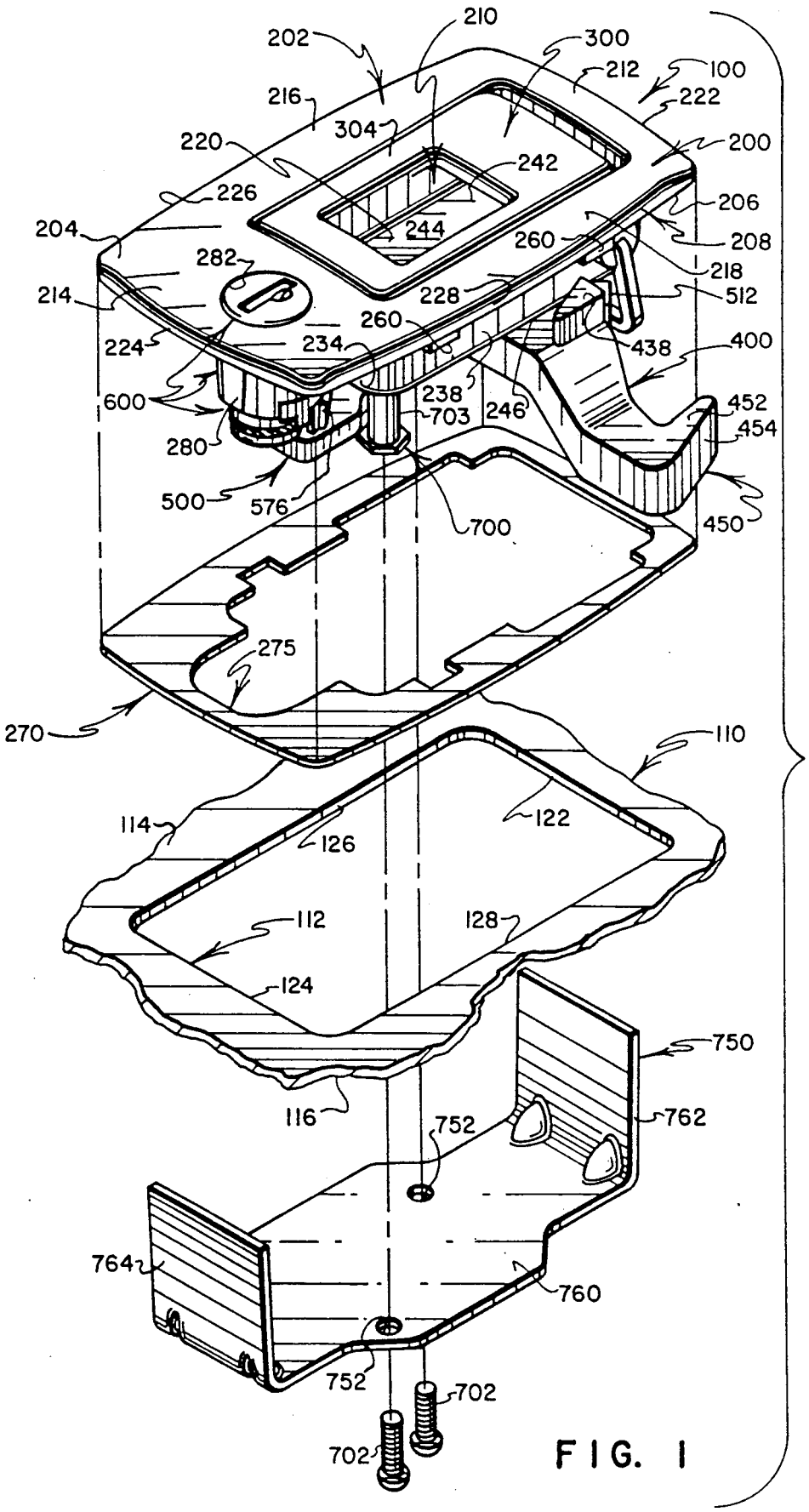
FIG. 1 is an exploded perspective view of one form of lock assembly that embodies features of the preferred practice of the present invention, illustrating how the lock assembly is mounted on portions of a closure, with the view showing principally front portions thereof.

Referring to FIG. 1, one form of a lock assembly that embodies features of the preferred practice of the present invention is indicated generally by the numeral 100. The lock assembly 100 has a housing 200 that mounts a plurality of interactive components that provide latching and locking functions. In preferred practice, latch and lock components that are described below are formed either from a durable thermoplastics material that will be described, or from stainless steel, whereby the resulting latch and lock units can be utilized in most normal environments without concern about deterioration from causes such as corrosion.

In overview, and as will be explained in greater detail, the interactive components that are carried on the housing 200 principally include a handle 300 that is mounted on the housing 200 for movement between normal and operating positions; a spring-biased latch bolt 400 that is pivotally mounted on the housing 200 for movement between latched and unlatched positions; an operating arm 500 that is pivotally mounted on the housing 200 for movement between "normal" and "operating" positions (with these positions corresponding, respectively, to the "normal" and "operating" positions of the handle 300), with the operating arm 500 serving a principal function of drivingly interconnecting the handle 300 and the latch bolt 400 such that the latch bolt 400 will move to its "unlatched" position in response to movement of the handle 300 to its "operating" position; and, a locking mechanism 600 for selectively permitting and preventing movement of the latch bolt 400 by the handle 300 (as by selectively permitting and preventing movement of the operating arm 500 from its normal position to its operating position). If the locking mechanism 600 is omitted, the lock assembly 100 is thereby transformed into a latch assembly, i.e., a unit which has a handle 300 that always can be operated to effect pivotal unlatching movement of the spring-biased latch bolt 400. Additional explanation is provided later in this document concerning such features as these that are simply being introduced to the reader in this introductory portion of the detailed description.

Referring to FIG. 1, it will be seen that the latch bolt 400 projects relatively sidewardly with respect to the housing 200 and has a hook-shaped end region 450 for engaging a suitably configured keeper or striker formation (not shown). In preferred practice, the lock assembly 100 is mounted on a closure (portions of which are indicated in FIG. 1 by the numeral 110) that is slidable sidewardly relative to structure (not shown) that surrounds and defines an access opening (not shown) through which access is selectively permitted and prevented as by selectively "opening" and "closing" the closure 110.

In referenced U.S. Pat. No. 4,511,166, a door lock 10 is described and illustrated that is provided with a pair of "slam capable" latch bolts. Each of the latch bolts have a hook-shaped, sidewardly projecting arm portion that is "slammable" into a "hooked" type of releasable latching engagement with a suitably configured keeper or striker formation. In much the same fashion, the lock assembly 100 has a single latch bolt 400 that has a hook-shaped portion 452 that is "slammable" into engagement with a suitably configured keeper or striker formation (not shown). The hook-shaped formation 452 is defined, in part, by a tapered surface portion 454 that is intended to engage a portion of a keeper or striker formation so as to cause the latch bolt to pivot such that its hook-shaped formation 452 will ride "down and under" (or "up and over") a portion of the keeper or striker so that the hook-shaped formation 452 can "hook" behind a portion of the keeper or striker—and can thereby serve to releasably retain the closure 110 in its closed position.

In a typical application, the lock assembly 100 is mounted near a "leading edge" region of the closure 110 (i.e., a an edge region of the closure 110 that "leads" or "moves ahead of" the majority of the other portions of the closure 110 as the closure is moved from an "open" to a "closed" position), with the hook-shaped end region 452 being configured to be pivoted out of the way of, to move by, and thence to hook behind so as to latchingly engage a portion of a suitably configured keeper or striker formation that is provided on the structure that surrounds the access opening that is "closed" when the closure is moved to its closed position. Thus, the latch bolt 400 is intended to function in the manner of the hook-shaped arms (referred to by numerals 160 and 162) of the door lock that is described in U.S. Pat. No. 4,511,166, to releasably "latch" the closure 110 in its closed position.

To "unlatch" the hook-shaped end region 452 from engagement with the keeper or striker (so that the closure 110 can be opened), 1) the hook-shaped end region 452 is pivoted to disengage the portion of the keeper or striker that had been "hooked," and 2) the closure 110 is slided sidewardly (i.e., out of its "closed" position toward its "open" position) to withdraw the hook-shaped end region 452 from being received by a suitably configured keeper or striker formation.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. The closure portion 110 has a front surface 114 and a rear surface 116 that extend about the perimeter of the opening 112. The opening 112 has top and bottom boundaries 122, 124, and left and right side boundaries 126, 128.

Figure 2:
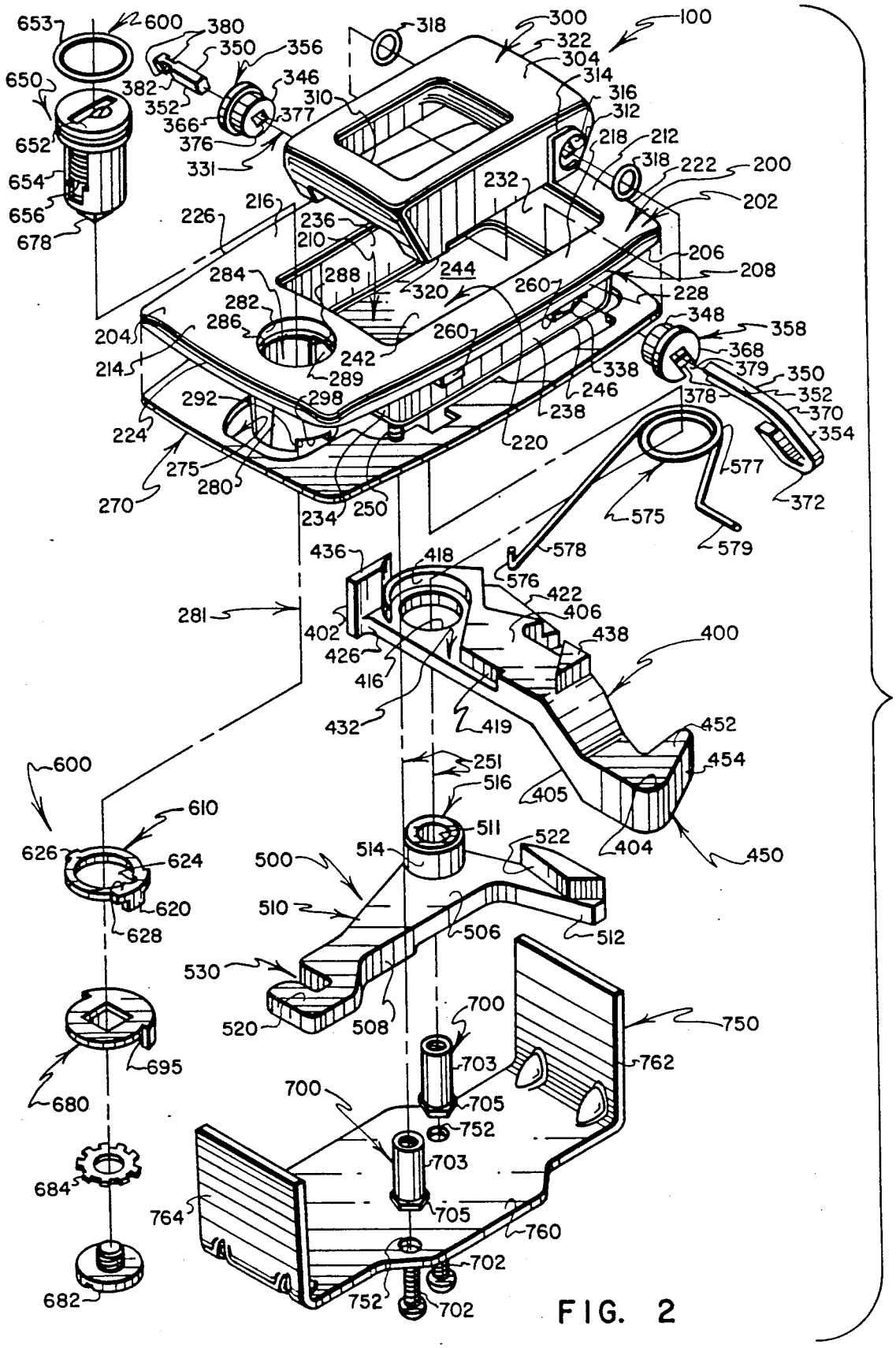
FIG. 2 is an exploded perspective view of components of the lock assembly of FIG. 1.

Referring to FIG. 2 in conjunction with what is depicted in FIG. 1, in order to mount the lock assembly 100 on the closure 110, the lock assembly 100 has a pair of mounting posts 700 (only one of which is shown in FIG. 1) that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward a perimetrically extending mounting flange 202 that comprises a part of the housing 200. The legs 762, 764 of the U-shaped mounting bracket 750 cooperate with the mounting flange 202 of the housing 200 to clampingly mount the lock assembly 100 on the closure 110.

When the lock assembly 100 is to be installed on the closure 110, a gasket 270 is positioned behind the mounting flange 202 to engage the rearwardly-facing surface of the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 270, to clamp the gasket 270 into engagement with the front surface 114, and to clamp the legs 762, 764 into engagement with a rear surface 116 of the closure 110.

The gasket 270 has a central opening 275 that is configured to permit the gasket 270 to be slipped over such portions of the lock assembly 100 as extend rearwardly from the mounting flange 202, so that the gasket 270 takes up a position adjacent the mounting flange 202. The central opening 275 can be configured (as is shown in FIG. 1) relatively complexly so as to extend into relatively close proximity to portions of the lock assembly 100 that are surrounded by the gasket 270. Alternatively, the gasket 270 can take a simpler configuration, such as is depicted in FIG. 1 of U.S. Pat. No. 4,841,755, so as to more loosely surround portions of the lock assembly 100. While the gasket 270 is not essential in many applications where the lock assembly 100 can be used, the gasket 270 preferably is used in applications that present a possibility that moisture, dust or the like may penetrate the opening 112 as by passing between the back face 206 of the mounting flange 202 and the front face 114 of the closure 110.

Figure 6:
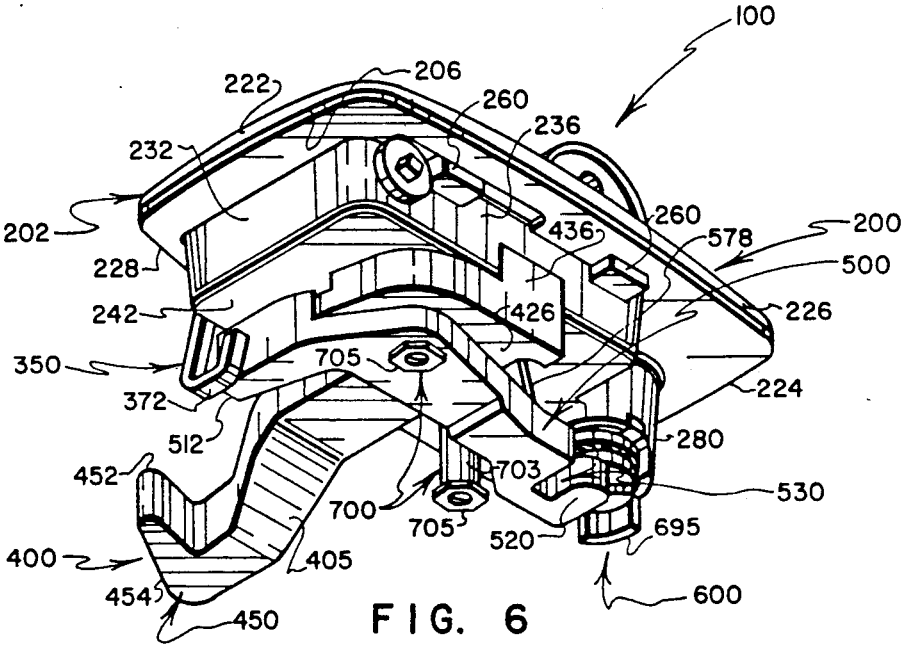
FIG. 6 is a perspective view showing principally rear portions thereof, but with the locking components unlocked.
Figure 7:
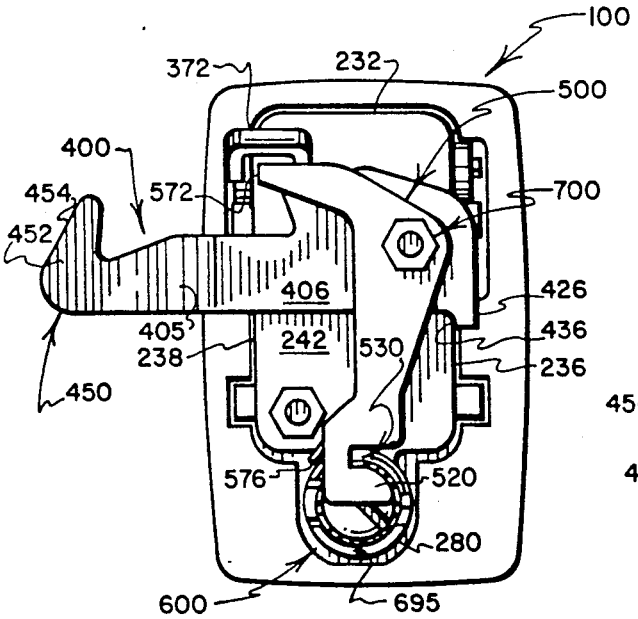
FIG. 7 is a rear elevational view similar to FIG. 4, but with the locking components unlocked.
Figure 8:
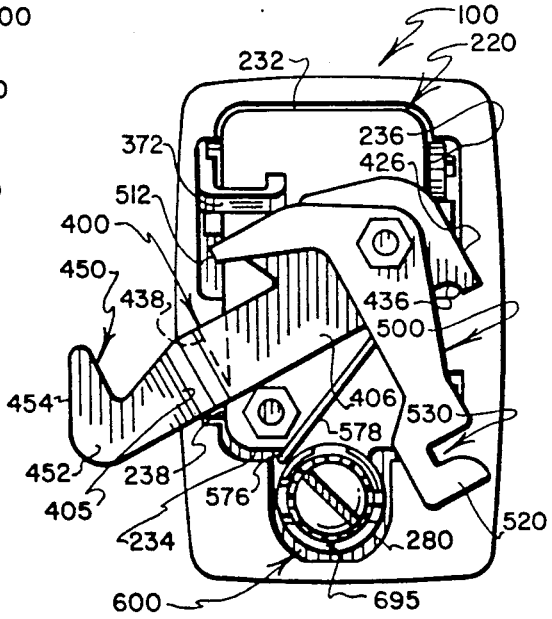
FIG. 8 is a is a rear elevational view similar to FIG. 7, but with the handle operated and with the latch bolt retracted to its unlatched position.
Figure 26:
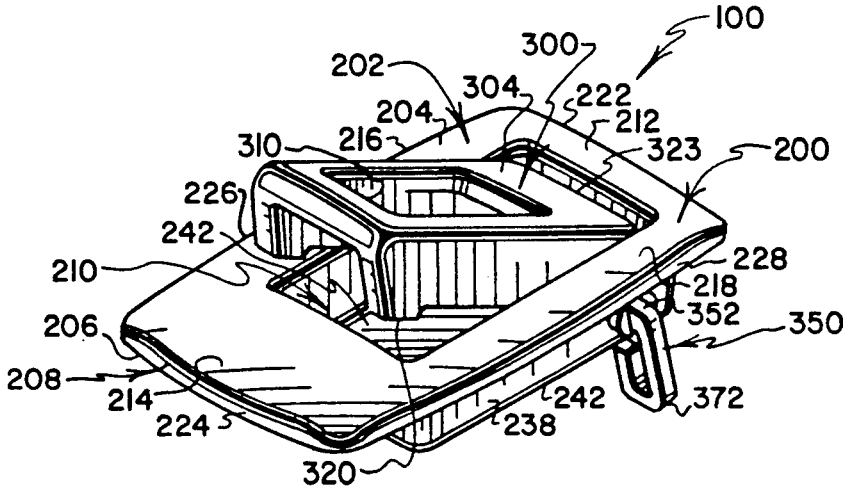
FIG. 26 is a perspective view of selected components of the lock assembly of FIGS. 1–8, with the handle operated.

To facilitate an understanding of the various relative positions of the principal relatively movable components of the lock assembly 100, reference is made to FIGS. 1-5 wherein the handle 300 is in its "normal" or "nested" position; the latch bolt 400 is in its "latched" position; the operating arm 500 is in its "normal" or "non-operating" position; and the lock mechanism 600 is "locked" so as to prevent movement of the operating arm 500 out of its "normal" position toward its "operating" position (i.e., to prevent unlatching movement of the latch bolt 400 in response to operation of the handle 300. In FIGS. 6-8, the locking mechanism 600 of the lock assembly 100 is shown "unlocked" so as to permit movement of the operating arm from its "normal" position (as shown in FIGS. 6 and 7 to its "operating" position (as shown in FIG. 8). In FIGS. 6 and 7, the latch bolt 400 is shown in its "latched" position; whereas, in FIG. 8, the latch bolt 400 is shown pivoted to its "unlatched" position in response to being acted upon by the operating arm 500 as the result of movement of the operating arm 500 in response to being acted upon by the handle 300 in moving from its "normal" or "nested" position to its "operating" position. The "operating" position of the handle 300 is shown in FIG. 26.

Figure 9:
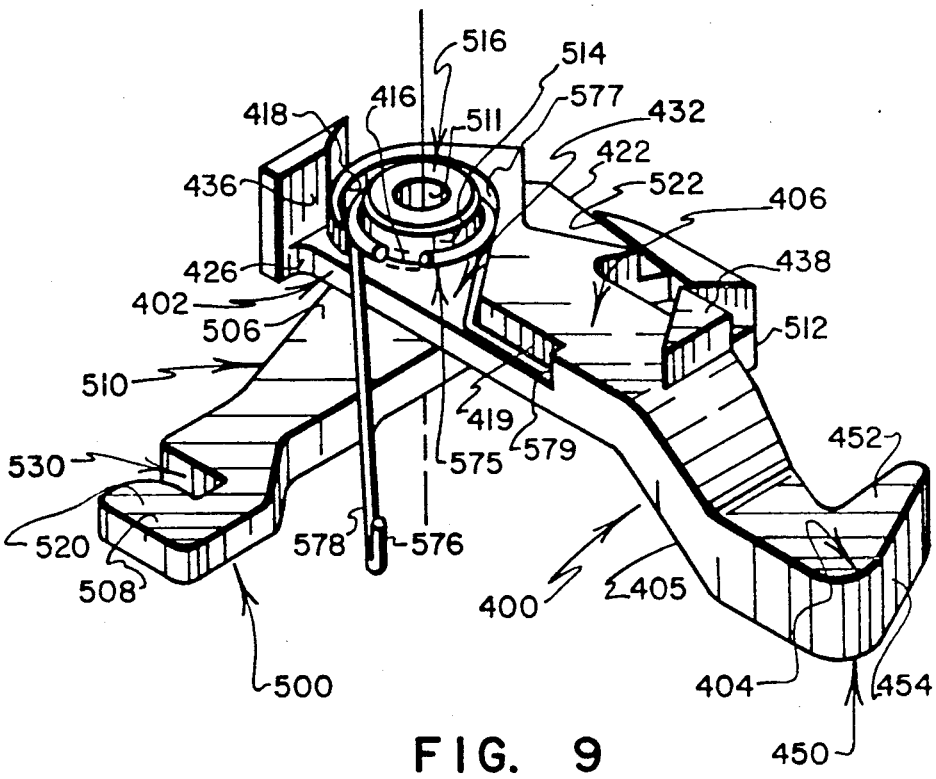
FIG. 9 is a perspective view, on an enlarged scale, of selected interactive components of the lock assembly of FIG. 1.

In the detailed description that follows, the lock assembly 100 and two alternate lock assembly embodiments 1100 and 2100 will be described. Features of the lock assembly 100 are depicted in FIGS. 1-8 and 26. Features of the lock assembly 1100 are depicted in FIGS. 10-17 and 27. Features of the lock assembly 2100 are depicted in FIGS. 18-25 and 28. The set of pivotal operating arm and latch bolt components that is depicted in FIG. 9 is described in conjunction with the discussion of the lock assembly 100, but is used in all of the embodiments 100, 1100 and 2100.

To the extent that the lock assemblies 100, 1100 and 2100 use identical parts, identical reference numerals are used to designate the identical parts. To the extent that the lock assemblies 100, 1100 and 2100 use differently configured parts that function substantially identically, reference numerals that differ by magnitudes of 1000 and 2000 are used to identify these components—whereby many of the features that are designated by four-digit reference numerals need not be described inasmuch as the character of these features will be apparent from the discussion that is presented of corresponding features that are designated by three digit reference numerals.

The lock assemblies 100, 1100 and 2100 share a general layout of operating components, with many of the operating components being interchangeable from lock to lock. Features shared by all three of these lock embodiments include the use of identically configured spring-biased, pivotally mounted latch bolts 400; the use of identically configured operating arms 500 that drivingly connect the latch bolts 400 with their associated operating handles 300, 1300 and 2300; and the use of identical arrangements of locking devices 600 to selectively restrict movement of the operating arms 500 so as to permit and prevent handle movement to effect unlatching movement of an associated one of the latch bolts 400, but with the locking devices 600 not interfering with the "slam capable" pivotally-movable nature of the latch bolts 400.

Principal areas of difference among the lock embodiments 100, 1100 and 2100 reside in the configuration of their handles 300, 1300 and 2300; the movements that are executed by the handles 300, 1300 and 2300 to effect pivot the operating arms 500 so as to pivot the operating arms 500 to effect "unlatching" movement of the latch bolts 400; the mountings of the handles 300, 1300 and 2300 on their associated housings 200, 1200 and 2200; and the character of such handles "extensions" as project through a back wall opening or through side wall opening(s) that are formed in the pan-shaped parts 220, 1220 and 2220 of the housings 200, 1200 and 2200 (as will be explained) for engaging the operating arms 500.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing 200 as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, Mass. 01201 under the registered trademark XENOY. The most preferred resin blend is about 10 percent glass reinforced, and is selected from the "6000 Series" of the XENOY products sold by General Electric, with XENOY 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

Referring to FIGS. 1 and 2, the mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

Figure 3:
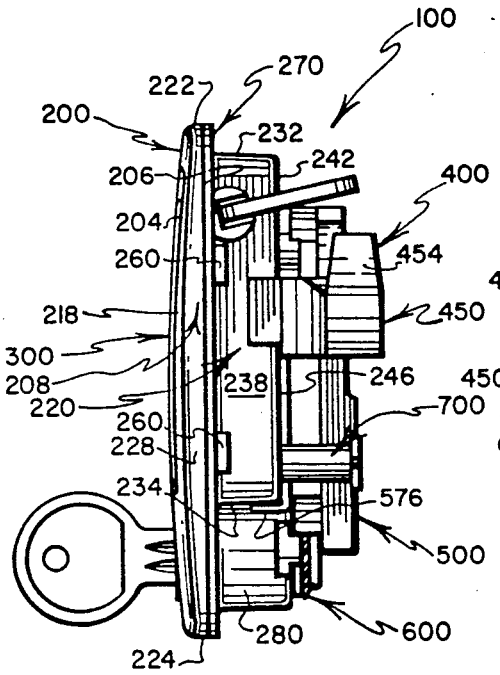
FIG. 3 is a right side elevational view thereof, with the handle in its normally nested position, with the latch bolt projected to its latched position, with locking components locked, but with selected portions removed therefrom to permit other portions to be seen.
Figure 4:
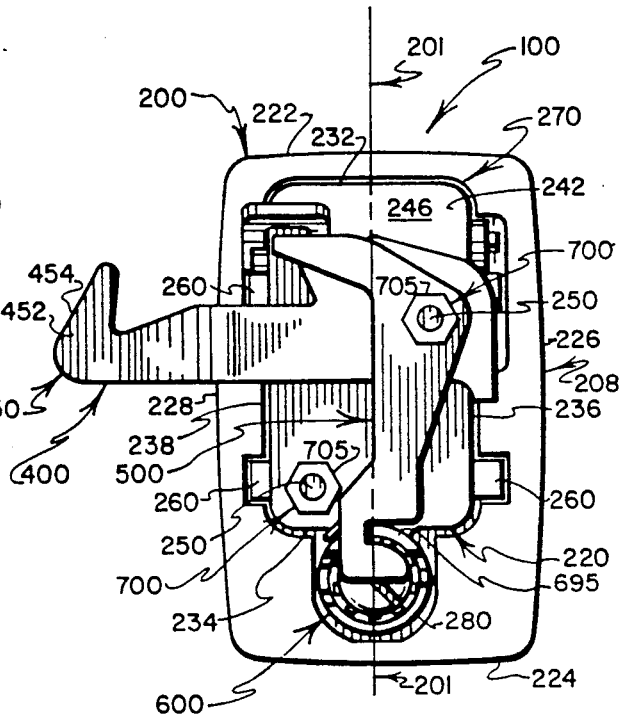
FIG. 4 is a rear elevational view thereof.
Figure 5:
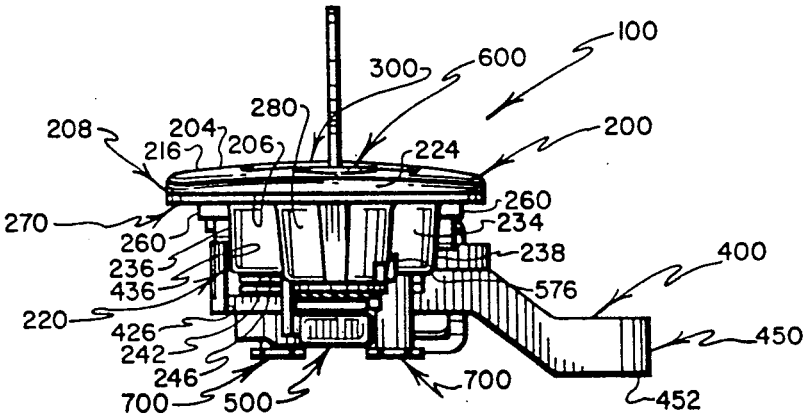
FIG. 5 is a bottom plan view thereof.

Referring to FIGS. 3–5, the pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 (see FIG. 2) and a rear face 246 (see FIG. 4) that extend in planes that substantially parallel the plane of the rear surface 206 of the mounting flange 202.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decreases progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is relatively narrow.

A feature of latch and lock units that embody the preferred practice of the present invention is that each such unit not only includes a compact, concentrically pivoted arrangement of its latch bolt 400 and its operating arm 500, but also includes arrays of functional formations and operating components that extend substantially symmetrically about an imaginary, vertically extending center plane. Such a center plane for the lock assembly 100 is designated by the numeral 201 in FIG. 4, and has features that are arranged symmetrically with respect thereto, such as the side walls 236, 238 of the housing portion 220 (which are spaced substantially equally on opposite sides of the center plane 201), and a sleeve-like housing formation 280 (which has its center intersected by the center plane 201). Corresponding center planes for the lock assemblies 1100 and 2100 are indicated by numerals 1201 and 2201 in FIGS. 13 and 21, respectively.

With respect to the side-to-side positioning of the recess 210 relative to features of the mounting flange 202, however, it will be understood that this is feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Referring to FIGS. 2 and 4, a pair of threaded studs 250 (only one appears in FIG. 2) project rearwardly from the rear face 246 of the back wall 242 for mounting various latch and lock components, as will be discussed. As is described and illustrated in the referenced Utility Cases I, II, III(a), III(b), IV and V, the studs 250 have enlarged head portions (not shown herein) that are embedded within the molded material of the back wall 242 of the housing 200 to provide threaded mounting formations that are anchored securely to the material of the plastic and will not rotate with respect thereto. The studs 250 have elongate threaded shank portions that project rearwardly from the rear wall 242 along spaced imaginary axes (designated by the numeral 251 in FIG. 2) that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

Locator projections 260 are provided at spaced locations along the side walls 236, 238 at junctures of the side walls 236, 238 with the rear face 206 of the mounting flange 202. As will be seen in FIG. 4, the locator projections 260 are arranged symmetrically in pairs on opposite sides of the center plane 201. The locator projections 260 are intended to directly engage opposite sides 126, 128 of the opening 112 to orient the lock assembly 100 properly on the closure 110; however, if the opening 112 has been formed so as to be slightly "oversized," the locator projections 260 may be utilized during installation of the lock assembly on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

The sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 (see FIG. 2) that lies within the imaginary center plane 201 and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figures 29, 30:
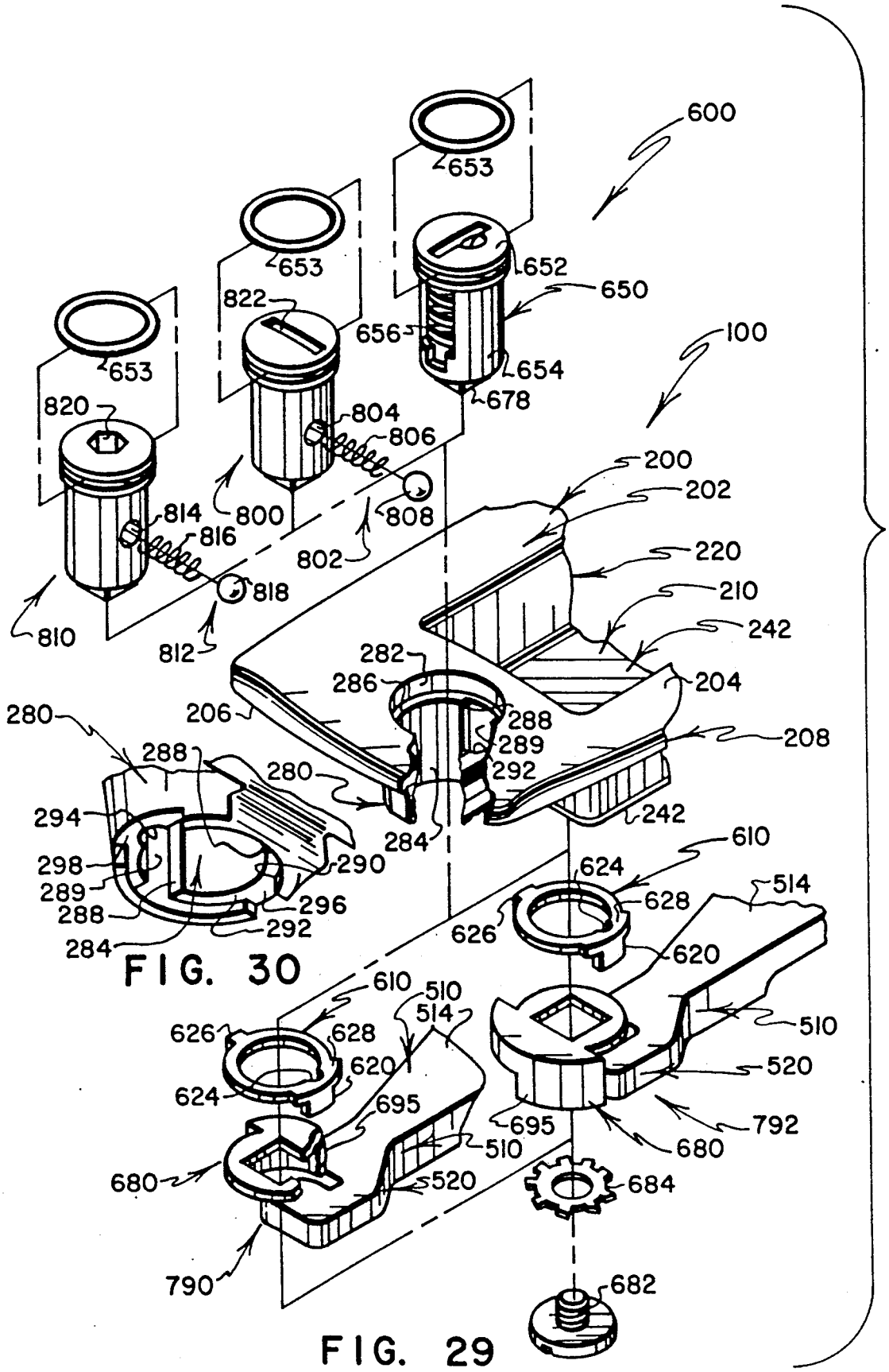
FIG. 29 is an exploded perspective view of selected portions of the lock assembly of FIGS. 1–8, with the view showing alternate tool-operated plugs that can be installed in the housing, and with the view showing locked and unlocked positions of selected components of the lock assembly of FIGS. 1–8, it being understood that what is depicted in FIG. 29 is equally applicable to the lock assemblies of FIGS. 10–17 and 18–25; and, FIG. 30 is a perspective view of rear portions of the housing that is shown in FIG. 29.

Referring to FIG. 29, a shoulder 286 extends substantially radially with respect to the axis 281 to form a transition between the relatively large diameter of the opening 282 and the relatively smaller diameter of the passage 284 Axially extending top and bottom grooves 288 are formed in opposed upper and lower portions of the passage 284. Referring to FIG. 30, the grooves 288 extend axially rearwardly from the shoulder 286 and have bottom walls 289 that are curved and represent continuations of a cylindrical surface 290 of enlarged diameter that is formed in the rearward end region of the sleeve 280. A radially extending shoulder 292 forms a transition between the passage diameter that is designated by the numeral 284, and the enlarged diameter end region 290. A rounded groove 294 of shallower depth than the grooves 288 is formed in a side of the passage portion 284. The rounded groove 294 extends from the shoulder 286 to the shoulder 292.

Two opposed portions 296, 298 of the shoulder 292 extend radially outwardly and interrupt opposed side portions of the sleeve formation 280 to provide radially extending, rearwardly opening notches that are designated by the numerals 296, 298.

In preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. Depending on the type of handle that is to be used with the housing 200, and on the type of latch or lock operating mechanism that is to be mounted on the housing 200, one or more suitable passages through the housing 200 are machined in the form of openings, holes, slots and the like which formed as by drilling, milling or other conventional machining techniques.

Figure 27:
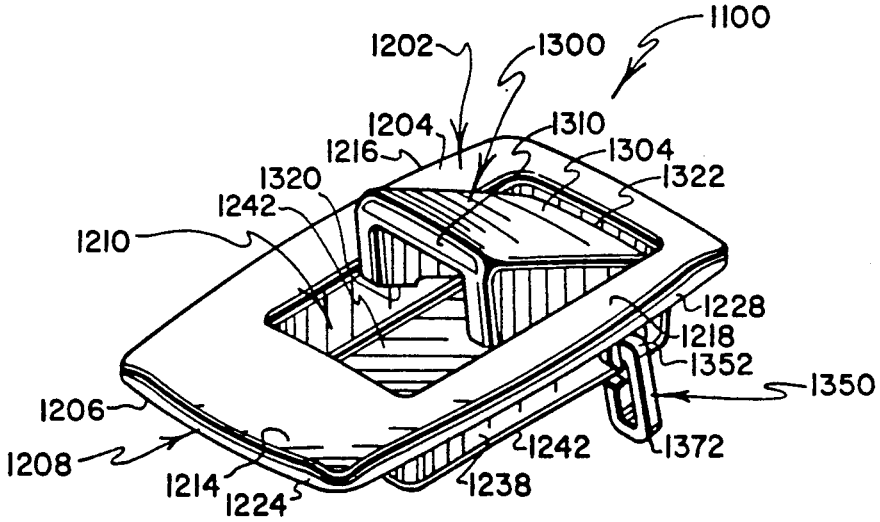
FIG. 27 is a perspective view of selected components of the lock assembly of FIGS. 10–17, with the handle operated.
Figure 28:
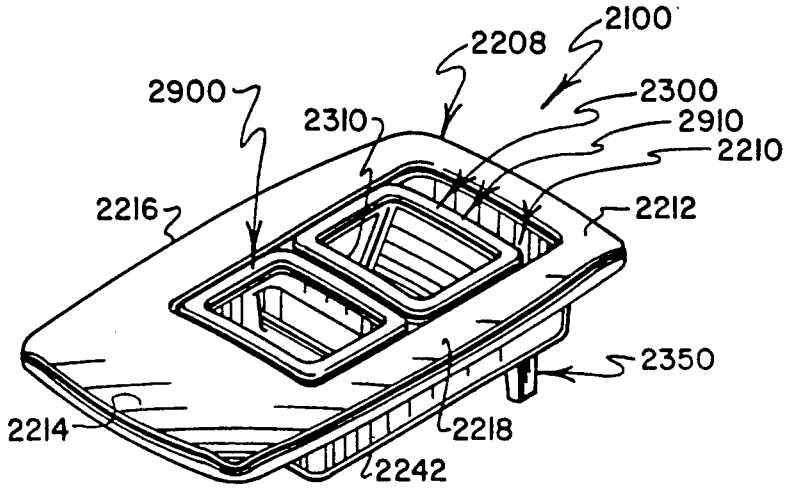
FIG. 28 is a perspective view of selected components of the lock assembly of FIGS. 18–25, with the handle operated.

The handles 300, 1300 and 2300 that are used in the housings 200, 1200 and 2200 are formed from molded plastics material, preferably of the same thermoplastics material from which the housings 200, 1200 and 2200 are formed. The handles 300, 1300 and 2300 have front surface portions 304, 1304 and 2304 that are of complexly curved, generally convex shape, and are configured to extend in a flush, substantially contiguous manner to smoothly continue the curvature of the complexly curved, convex front surfaces 204, 1204 and 2204 of the mounting flange 202, 1202 and 2202 when the handles 300, 1300 and 2300 are in their normal or nested position. The handle 300 is mounted on the housing 200 for movement between a normally nested position that is shown in FIGS. 1 and 3–7, and an operating position that is shown in FIG. 26 (also, rear portions of the handle 200 are shown in their operating positions in FIG. 8). The handle 1300 is mounted on the housing 1200 for movement between a normally nested position that is shown in FIGS. 10 and 12–16, and an operating position that is shown in FIG. 27 (also, rear portions of the handle 1200 are shown in their operating positions in FIG. 17). The handle 2300 is mounted on the housing 2200 for movement between a normally nested position that is, shown in FIGS. 18 and 20–24, and an operating position that is shown in FIG. 28 (also, rear portions of the handle 1200 are shown in their operating positions in FIG. 25).

Figure 11:
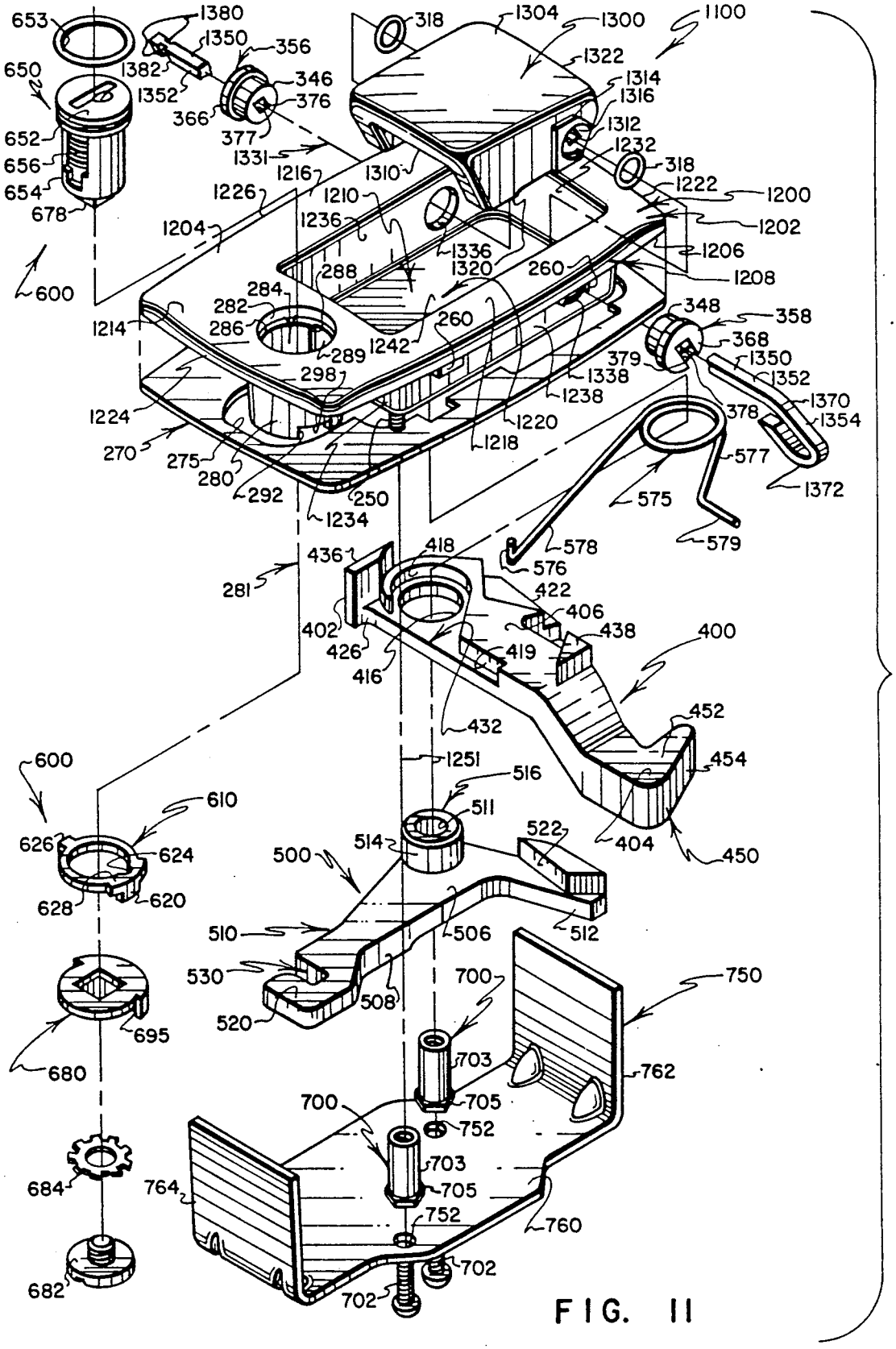
FIG. 11 is an exploded perspective view of components of the lock assembly of FIG. 10.
Figure 12:
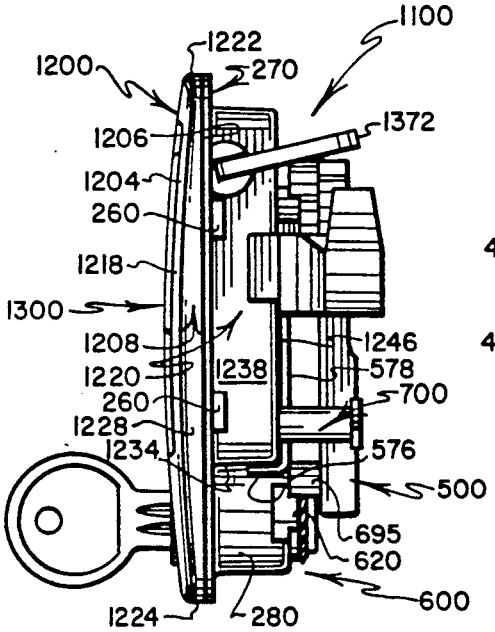
FIG. 12 is a right side elevational view thereof, with the handle in its normally nested position, with the latch bolt projected to its latched position, and with locking components locked, but with selected portions removed therefrom to permit other portions to be seen.
Figure 13:
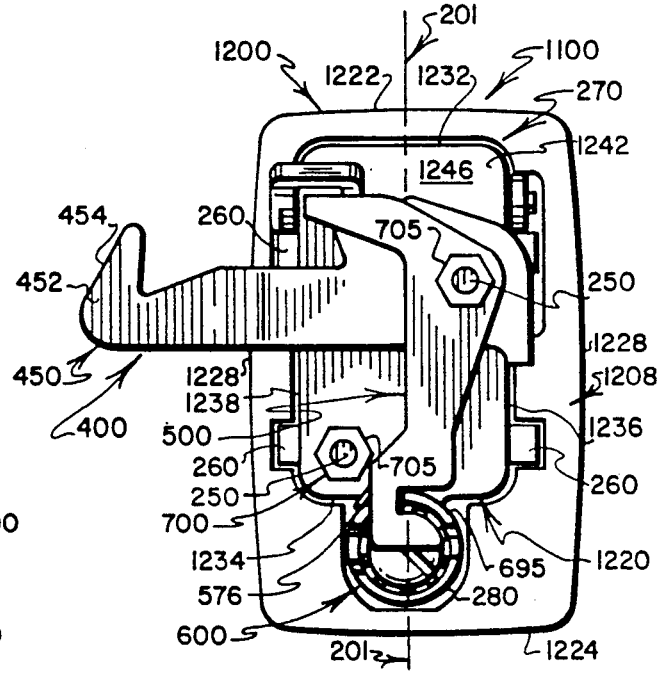
FIG. 13 is a rear elevational view thereof.
Figure 14:
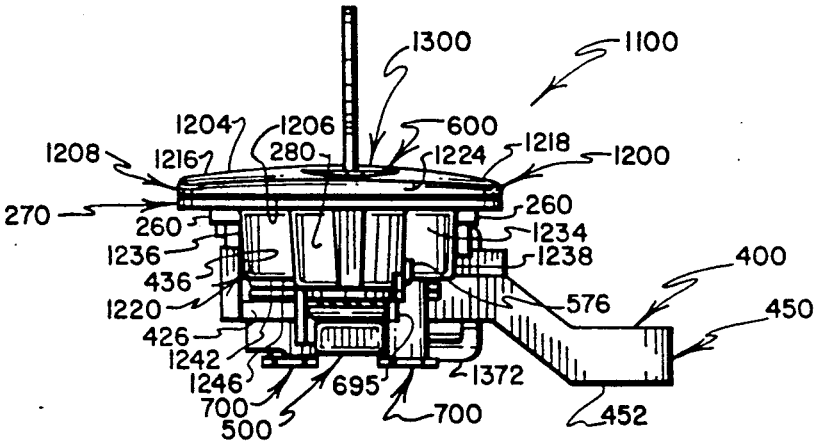
FIG. 14 is a bottom plan view thereof.
Figure 15:
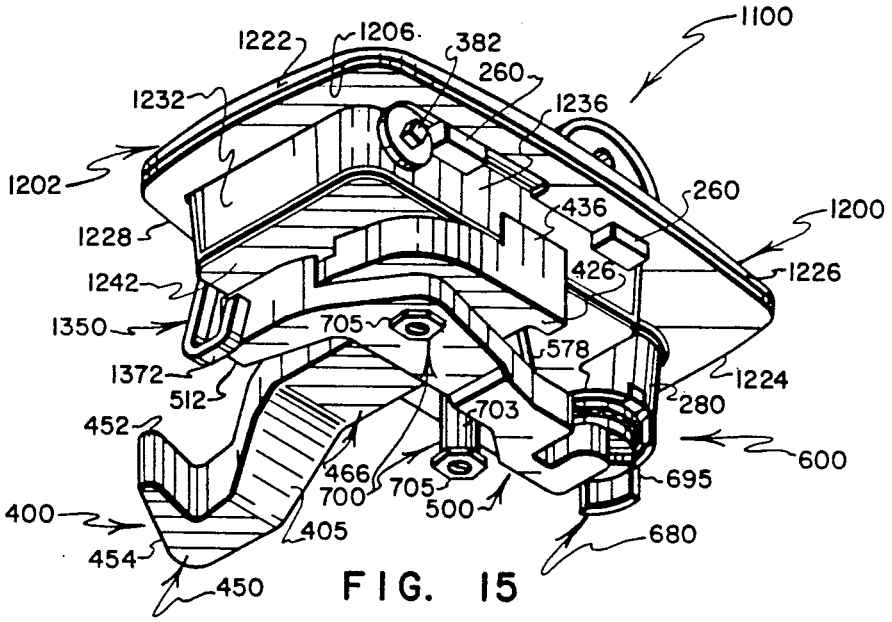
FIG. 15 is a perspective view showing principally rear portions thereof, but with the locking components unlocked.
Figure 16:
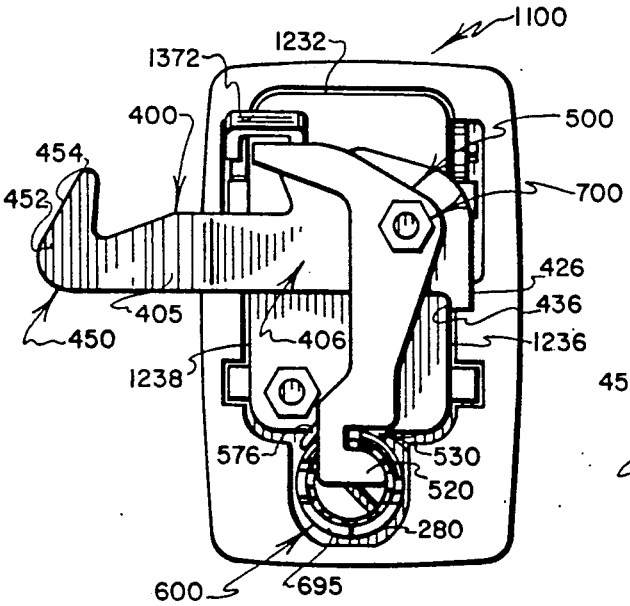
FIG. 16 is a rear elevational view similar to FIG. 13, but with the locking components unlocked.

The handles 300, 1300 and 2300 have shapes that let them nest and move with ease within the confines of their respective recesses 210, 1210 and 2210. Referring to FIGS. 2 and 11, the handles 300, 1300 have pivoted mounting portions that extend transversely across the recesses 210, 1210 and provide through passages 312, 1312 that are of square cross section for receiving handle mounting shafts 350, 1350 that also are of square cross section. The opposed end regions 314, 1314 of the mounting portions have cylindrical recesses 316, 1316 that surround the ends of the passages 312, 1312 for mounting O-rings 318.

Stop surfaces 320, 1320 are formed on depending portions of the handles 300, 1300 to engage the back walls 242, 1242 of the housings 200, 1200 when the handles 300, 1300 are nested in the recesses 210, 1210. Stop surface 322, 1322 are formed on the end regions of the handles 300 and 1300 for engaging the top walls 232, 1232 of the housing portions 220, 1220 when the handles 300, 1300 are in their operating positions.

The handles 300, 1300 and 2300 have operator engagement formations 310, 1310 and 2310 that can be engaged by an operator's hand (preferably by one or more fingers thereof) for moving the handles 300, 1300, 2300 between their normal or nested positions and their operating positions.

Referring to FIGS. 2 and 11, aligned handle mounting holes 336, 338 and 1336, 1338 are formed through the side walls 236, 238 and 1236, 1238 on opposite sides of the recesses 210 and 1210. The holes 336, 338 and 1336, 1338 are concentric about imaginary axes 331 and 1331 that extend substantially parallel to the back walls 242 and 1242, and that extend substantially perpendicular to the side walls 236, 238 and 1236, 1238, respectively.

The holes 336, 338 and 1336, 1338 are of equal diameters, and serve to journal reduced diameter end regions 346, 348 of a pair of bushings 356, 358. The bushings 356, 358 have relatively large diameter portions 366, 368 that extend alongside outer surfaces of the side walls 236, 238 and 1236, 1238. The O-rings 318 are positioned on the inside of the recess 316 and 1316 to surround the holes 336, 338 and 1236, 1238 to provide moisture seals that are compressed between opposite sides of the handle 300, 1300 and inner surfaces of the housing walls 236, 238 and 1236, 1238.

The bushings 356, 358 have square holes 376, 378 formed therethrough that extend along the imaginary axes 331 and 1331. The hole 378 that is formed in the bushing 358 has an end region 379 that is widened to receive a corner bend of a handle mounting shaft 350. The hole 376 that is formed in the bushing 356 can be "narrowed" on opposite sides as by providing opposed projections 377 that extend inwardly from opposite sides of portions of the hole 376—it being understood that the purpose of this exercise is to provide a means of retaining the bushing 356 on one of the handle mounting shafts 350, 1350 (i.e., grooves 380, 1380 preferably are provided in the handle shaft end regions, and the projections 377 can be inserted into these grooves; alternately, the grooves 380, 1380 can be engaged by a conventional, commercially available gripping type fastener (not shown) such as a conventional snap ring or the like.)

The handle mounting shafts 350, 1350 are formed from stainless steel stock of square cross section, and are provided with leg portions 352, 354 and 1352, 1354 that are connected by curved, right-angle bends 370 and 1370, respectively. The legs 354 and 1354 connect with U-shaped end regions 372 and 1372 that are referred to elsewhere in this document by the term "handle-connected members"—the intention being to denote that the U-shaped end regions 372 and 1372 are rigidly connected to their associated operating handles 300 and 1300 and therefore pivot with the handles 300, 1300 relative to the housings 200, 1200. The legs 352 and 1352 extend through the bushing holes 376, 378 and the handle passages 312 and 1312. In the embodiments depicted in the drawings, the grooves 380 and 1380 that are formed in opposite sides of end regions 382 and 1382 of the legs 352 and 1352 are used to receive the bushing projections 377.

Figure 10:
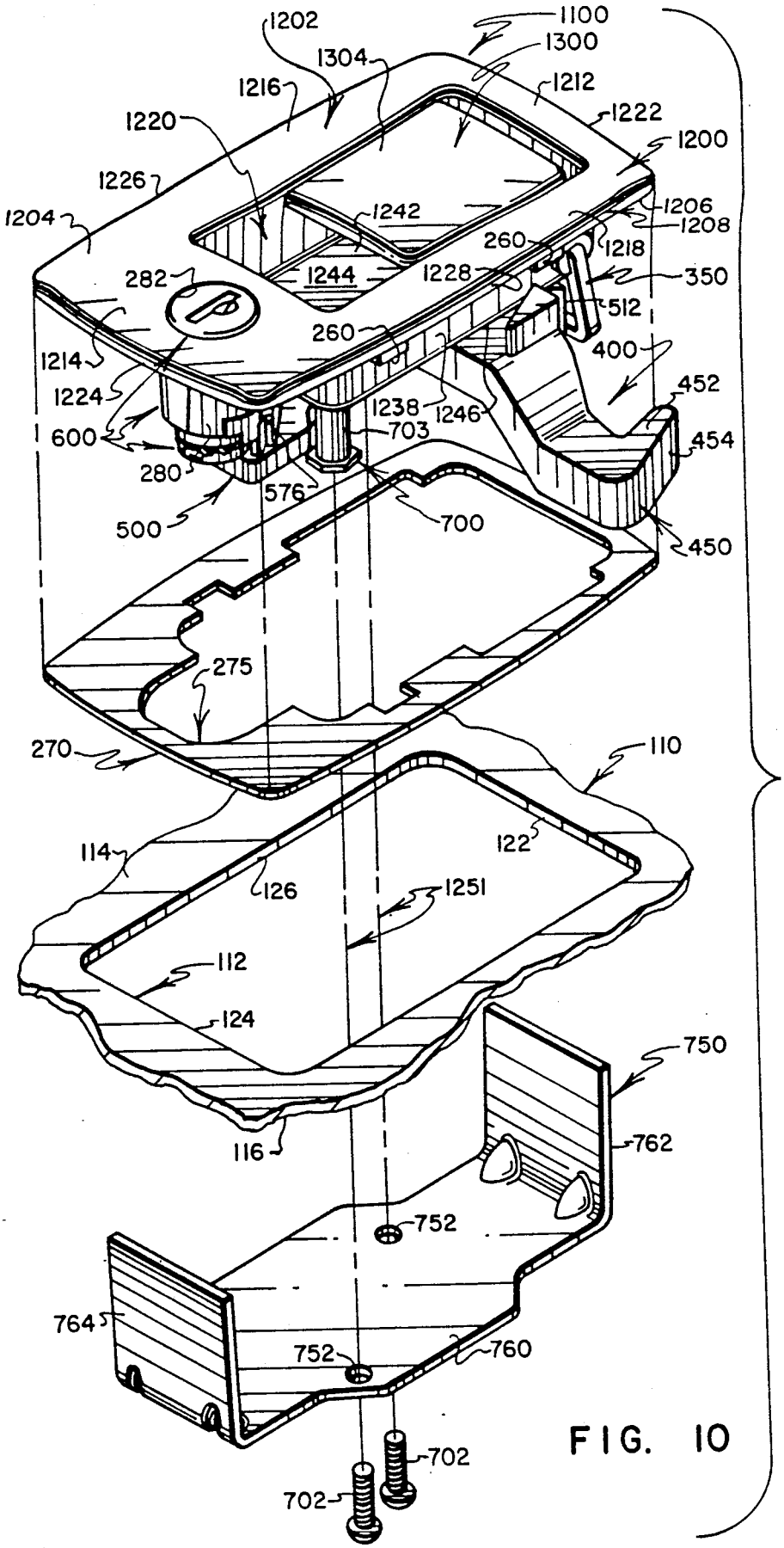
FIG. 10 is an exploded perspective view of another form of lock that embodies features of the preferred practice of the present invention illustrating how the lock assembly is mounted on portions of a closure, and with the view showing principally front portions thereof.
Figure 17:
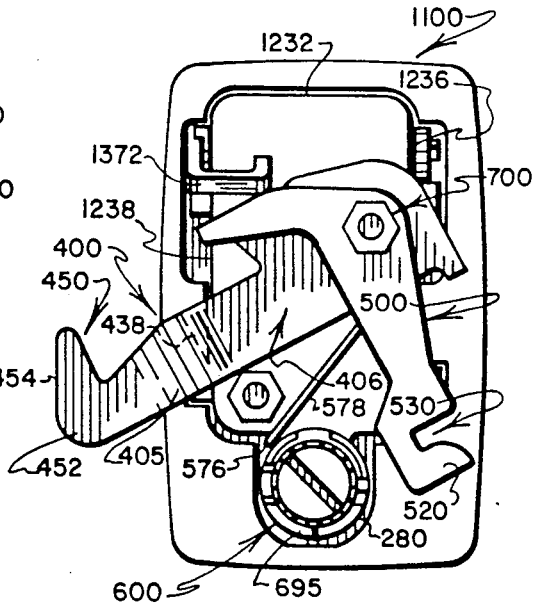
FIG. 17 is a is a rear elevational view similar to FIG. 16, but with the handle operated and with the latch bolt retracted to its unlatched position.
Figure 18:
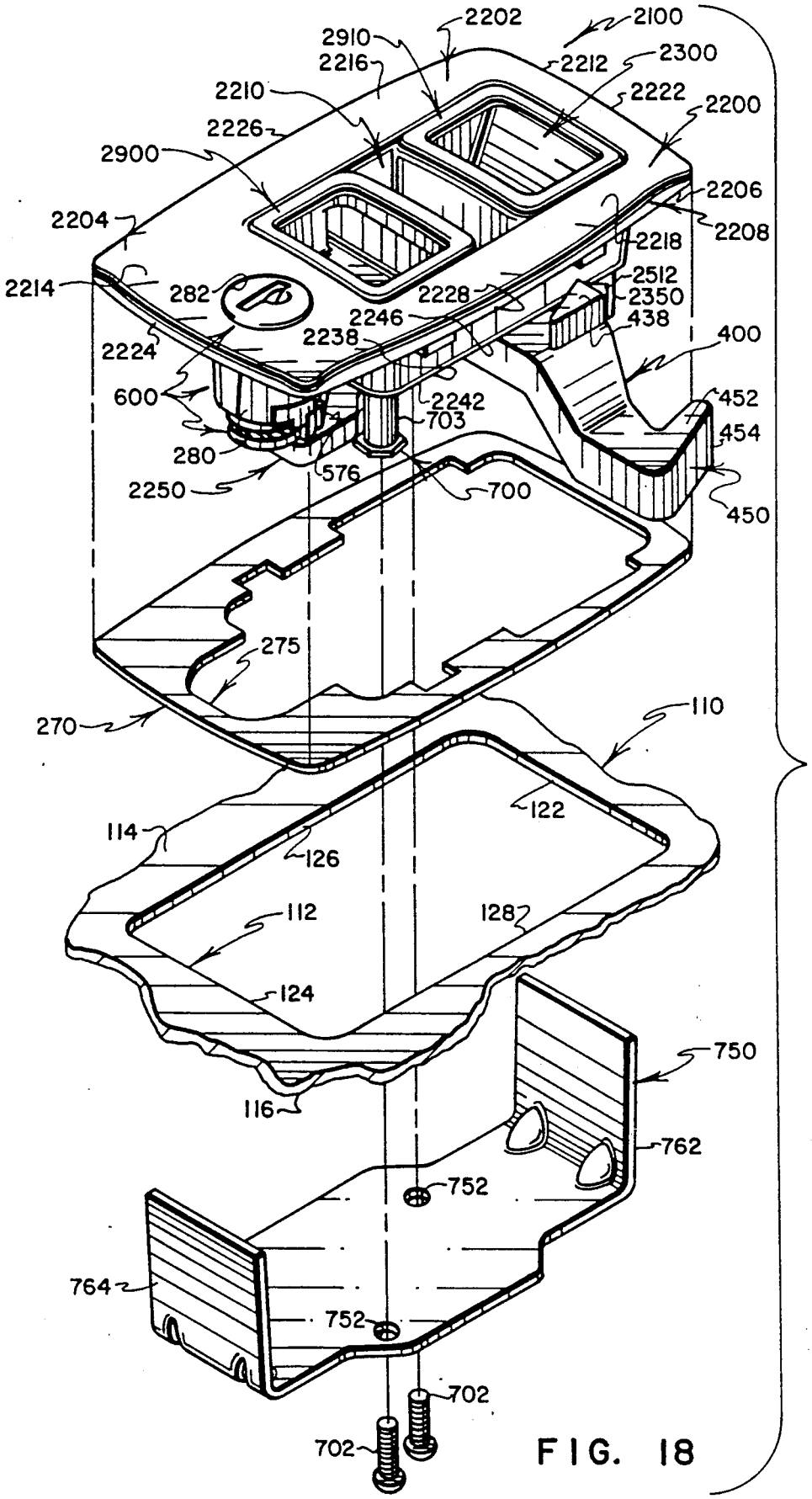
FIG. 18 is an exploded perspective view of still another form of lock that embodies feature of the preferred practice of the present invention illustrating how the lock assembly is mounted on portions of a closure, with the view showing principally front portions thereof.
Figure 25:
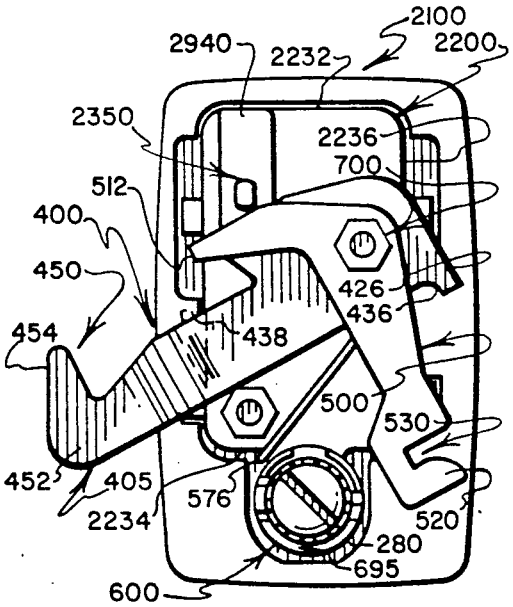
FIG. 25 is a is a rear elevational view similar to FIG. 24, but with the handle operated and with the latch bolt retracted to its unlatched position.

With respect to each of the lock assemblies 100, 1100 and 2100, its associated latch bolt 400 is mounted on an associated one of the housings 200, 1200 and 2200 for pivotal movement between a latched position (wherein the latch bolts 400 extend sidewardly relative to their associated housings 200, 1200 and 2200 as is depicted, for example, in FIGS. 1, 10 and 18, respectively), and an unlatched position (that is depicted in FIGS. 8, 17 and 25, respectively).

For purposes of permitting portions of the latch bolt 400, the operating arm 500 and a torsion coil spring 575 (that is used to spring-bias the latch bolt 400, as will be explained) to be viewed, reference is made to the depiction of a set of these components that is presented in FIG. 9. The orientation of the components that is depicted in FIG. 9 is quite easily understood if the reader will simply compare what is depicted in FIG. 9 which such portions of these same components as appear in FIGS. 1, 10 and 18—for the component orientation that is shown in FIG. 9 corresponds exactly to the component orientation that is depicted in FIGS. 1, 10 and 18. Thus, what is shown in FIG. 9 includes a depiction of the latch bolt 400 in its "latched" position, and a depiction of the operating arm 500 in its "normal" or "non-operated" position.

The latch bolt 400 and the operating arm 500 are coaxially but independently mounted for pivotal movement about the axis of the post-like fastener 700. Referring to FIG. 2, the operating arm 500 has a sleeve-like formation 516 that defines a mounting hole 511. The hole 511 is sized to receive a generally cylindrical portion 703 of the post-like fastener 700 in a slip fit so as to pivotally mount the operating arm 500 for pivotal movement relative to the housing 200 about the axis 251 of the fastener 700. The outer diameter of the sleeve-like formation 516 is received in a slip fit in a relatively large diameter hole 416 that is formed through the latch bolt 400. By this arrangement, the latch bolt 400 is mounted for pivotal movement relative to the housing 200 about the axis 251 of the fastener 700 (with either of the latch bolt 400 and the operating arm 500 being free to pivot relative to each other).

The latch bolt 400 is an elongate member that has opposed first and second end regions 402, 404 that are connected by a central region 406. The inner end region 402 defines a mounting formation that takes the form of the relatively large diameter hole 416 that is described above. A part of the inner end region 402 that is designated in FIG. 9 by the numeral 426 is intended to extend beyond the side of the back wall 242 (i.e., beyond the confines of the side wall 236 of the recess-defining portion 220 of the housing 200 (as is shown in FIG. 6). A stop formation 436 is carried by the inner end region part 426. The stop formation 436 is configured to engage the side wall 236, as is best seen in FIG. 5, when the latch bolt 400 is in its latched position—whereby the "latching" movement of the latch bolt 400 is limited by the action of the stop formation 436.

The outer end region 404 of the latch bolt 400 defines what has previously been referred to as the hook-shaped end region 452. The "slam engagement surface" 454 is defined on outer portions of the end region 452, and is slanted so that, if this surface is engaged by a striker formation (not shown) that is moving relatively toward the housing 200, the latch bolt 400 will be caused to pivot briefly toward its unlatching position (i.e., to a sufficient extent to permit the striker formation to pass by the hook shaped end region 452 whereafter the latch bolt 400 typically would return to its latched position under the influence of the torsion coil spring 575 so as to latchingly engage the striker formation as by "hooking" it with the hook shaped end region 452).

The central region 406 extends across the back wall 242 and beyond the side wall 238 to a position where a stop formation 438 is defined. In FIG. 8, the stop formation 438 is shown in phantom to illustrate that, when the latch bolt 400 is pivoted to its unlatched position, the stop formation 438 engages the side wall 238 to stop further unlatching movement of the latch bolt 400. The central portion 406 has an edge portion 422 that serves as a drive engagement surface to drivingly engage a corresponding drive engagement formation 522 that is provided on the operating arm 500, as will be explained in greater detail.

Referring principally to FIG. 9, a hollowed out or cut out formation 432 is provided in the inner end portion 402 and extends to the central portion 406 to receive portions of the torsion coil spring 575. The cutout 432 includes a portion 418 that extends about the hole 416 (to receive a coiled central portion 577 of the torsion coil spring 575) and a portion 419 that extends along one edge of the central region 406 (to receive a leg portion 579 of the spring 575). A leg portion 578 of the spring 575 extends from the coil 577 across portions of the cutout 432, across portions of the backwall 242, and has an L-shaped end region 576 that extends along the bottom wall 234 of the recessed pan portion 220 at a location adjacent the sleeve formation 280, as is best seen in FIG. 8.

In the lock embodiments that are shown in the drawings hereof, the latch bolt 400 has an offset or "dogleg" portion 405 that functions to rearwardly position the hook-shaped end region 452. If a particular application does not require such an offset, or if a greater offset is needed, the configuration of the latch bolt 400 can be appropriately adjusted, as will be readily understood by those who are skilled in the art.

The operating arm 500 has a central region 506, with a pair of legs 508, 512 that cooperate with the central region to define a generally L-shaped member that is referred to elsewhere herein by the reference numeral 510. Referring to FIG. 2, a triangular drive formation 522 is carried on the leg 512 for engaging the drive formation 422 of the latch bolt 400 so as to transfer directly through the drive formation 522 such handle-operated force as is generated by moving the handle 300 from its nested position to its operated position—which, in turn, causes the U-shaped end region 372 of the handle-connected member 350 to apply force to the drive formation 522, which transmits that force to the drive formation 422 and thereby causes movement of the latch bolt 400 from its latched position to its unlatched position.

The leg 508 of the operating arm 500 defines a generally U-shaped slot or groove 530 that gives the end region of the leg 508 a hook-shaped appearance that is referred to elsewhere herein by the reference numeral 520. As will be explained, the groove 530 is provided to receive a movable portion of the locking device 600 that is selectively movable into and out of the path of movement that is followed by the leg 508 when the operating arm 500 is pivoted from its normal, non-operated position to its operated position. By this arrangement, the locking device 600 serves to selectively restrain the operating arm 500 from moving out of its normal, non-operated position, and thereby serves to "lock" the lock assembly 100.

In effect, the two legs 508, 512 of the L-shaped operating arm 500 perform separate functions. The leg 512 (which carries the operating formation 522) functions to transmit force between the operating handle 300 and the latch bolt 400 so as to effect "unlatching" movement of the latch bolt 400 in response to the operating handle's being moved out of its nested position to its operated position. The leg 508, on the other hand, cooperates with the locking device 600 to selectively prevent movement of the operating arm 500 in response to attempted movement of the operating handle 300; and, since the handle 300 cannot move out of its nested position if the operating arm 500 is not free to pivot about the post-like fastener 700, if the operating arm 500 is "locked" against moving from its normal, non-operated position, so is the handle 300.

The action of the torsion coil spring 575 serves to bias the latch bolt 400 in a direction away from its unlatched position (as shown in FIG. 8) toward its latched position (as shown in FIGS. 1 and 3–7). The spring end region 576 engages the housing 200; the end region 579 engages the latch bolt 400; and, the torsion coils 577 effect the described biasing action as by tending to cause relative movement of the spring end regions 576, 579 about the axis 251 of the fastener 700. A feature of the action of the torsion coil spring 575 is that its biasing action is so strong as to be transmitted from the latch bolt 400 through the operating arm 500 to the handle 300 so as to normally maintain both the operating arm 500 and the handle 300 in their normal, non-operated positions.

Just as the stop formations 436, 438 control the range of pivotal movement of the latch bolt 400, the fact that the torsion coil spring 575 tends to maintain engagement between the drive formations 422, 522 causes the action of the stop formations (as described above) to likewise define the range of pivotal movement that is executed by the operating arm 500.

Because the lock assembly 2100 has an operator graspable handle 2300 that slides within the recess 2210 rather than pivots relative to its associated housing 2200 (as is the case with the handles of the lock assemblies 100 and 1100), a brief discussion is in order concerning the unique character of this sliding handle embodiment.

Referring to FIGS. 18–25 and 28 wherein features of the lock assembly 2100 are depicted, two operator engageable structures 2900, 2910 are nested in the recess 2210. The structures 2900, 2910 are identical in many essential respects, with one principal difference residing in the fact that the structure 2900 is rigidly bonded to the housing formation that surround the recess 2210, while the structure 2910 is a handle that is movable relative to the housing 2200 along the length of the recess 2210. A slot 2912 (shown in FIG. 19 in a gap that is provided as by breaking away portions of the housing 2200) is formed through the housing back wall 2242 to receive a handle carried arm or projection 2350 that extends through the slot 2912 for engaging the operating arm 500 to move the " arm 500 to unlatch the lock or latch 2100.

Figure 19:
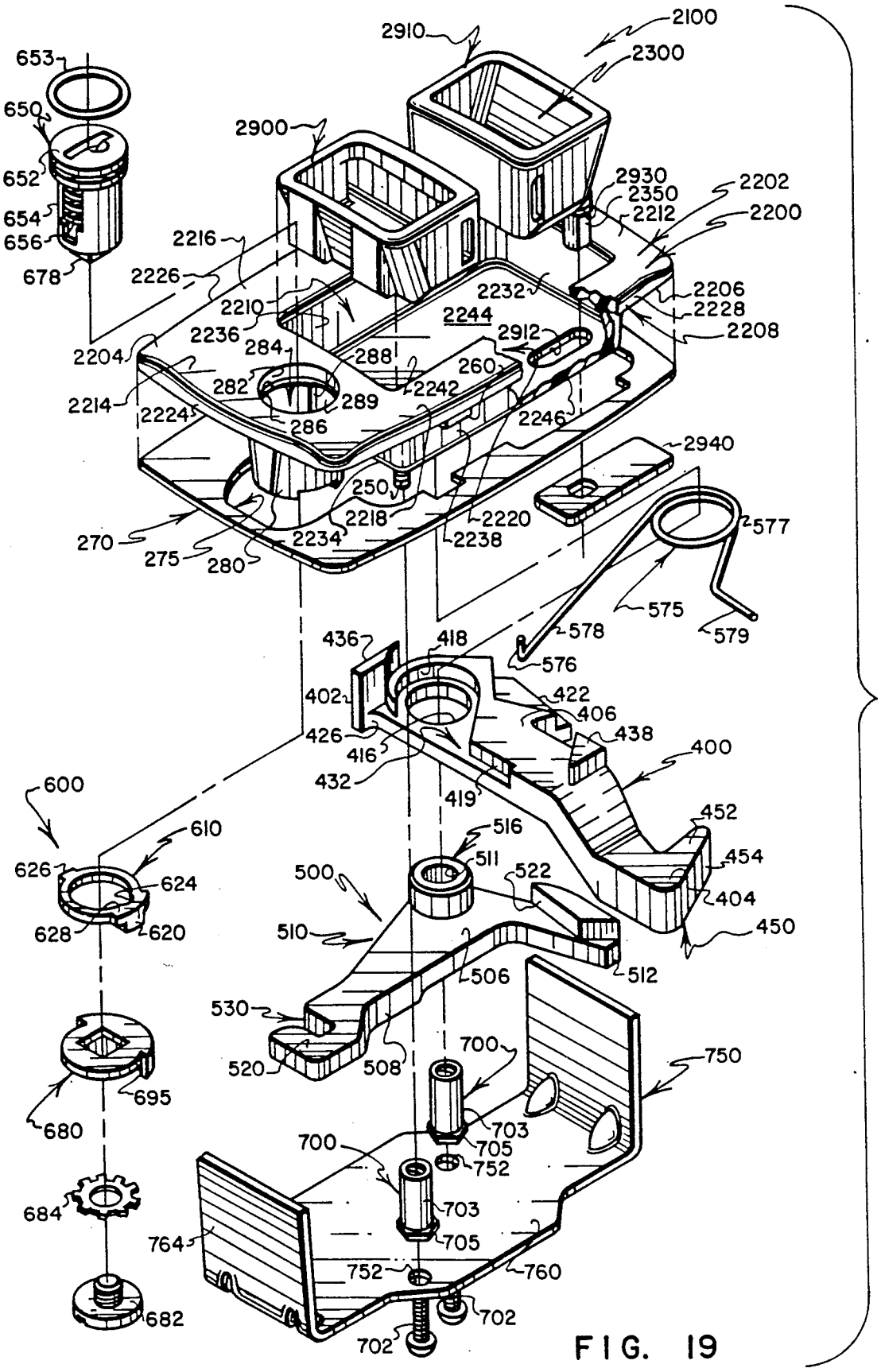
FIG. 19 is an exploded perspective view of components of the lock assembly of FIG. 18.
Figure 20:
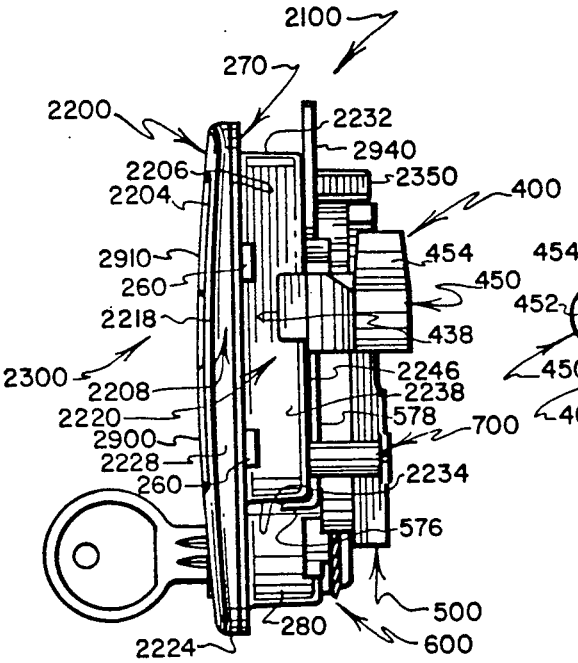
FIG. 20 is a right side elevational view thereof, with the handle in its normally nested position, with the latch bolt projected to its latched position, and with locking components locked, but with selected portions removed therefrom to permit other portions to be seen.
Figure 21:
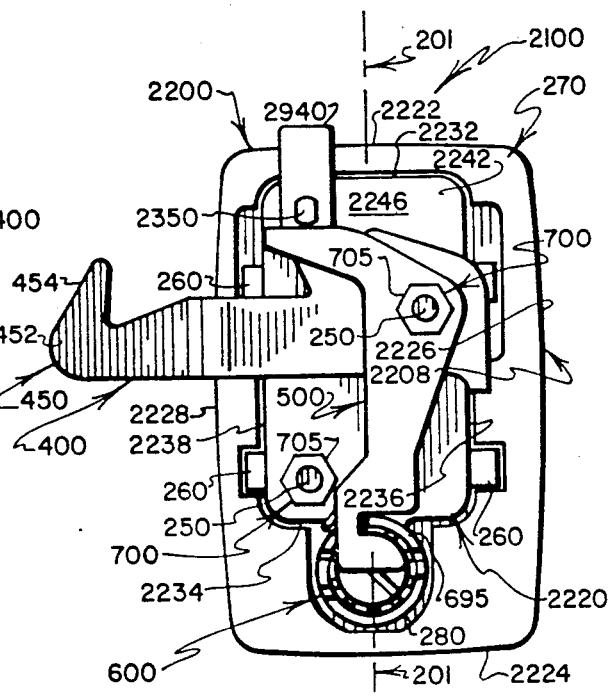
FIG. 21 is a rear elevational view thereof.
Figure 22:
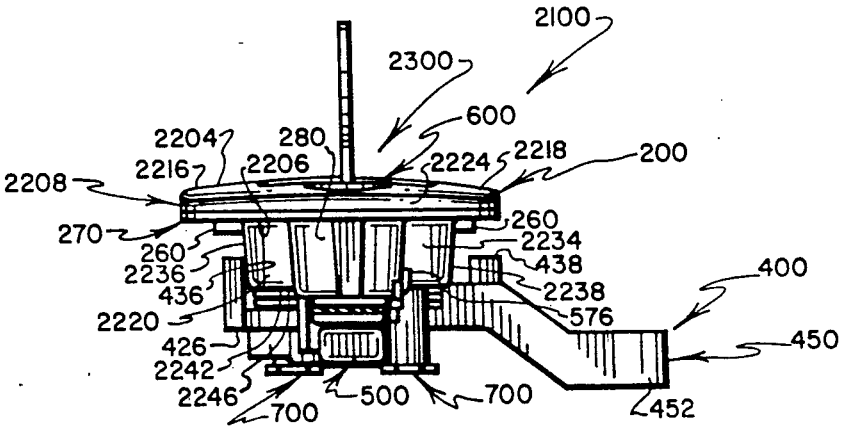
FIG. 22 is a bottom plan view thereof.
Figure 23:
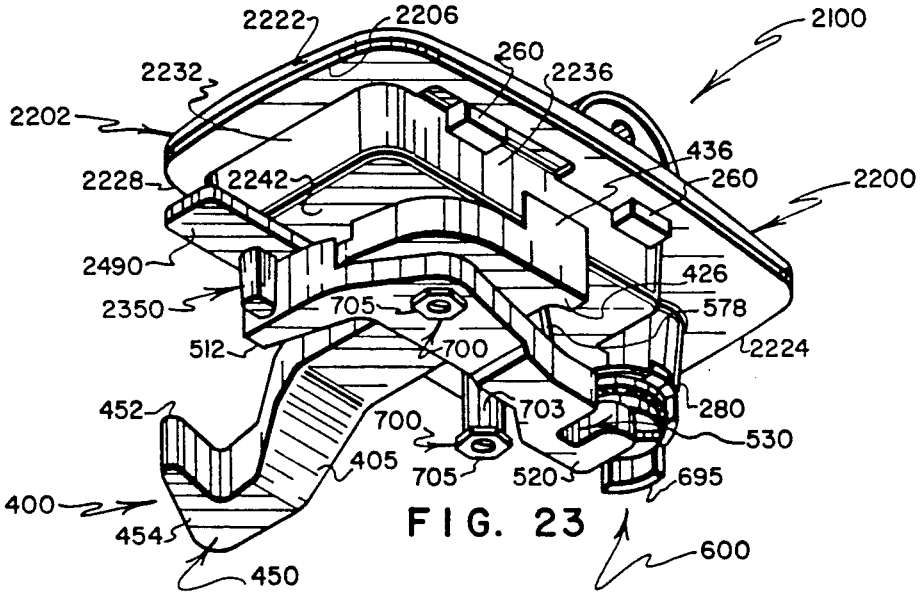
FIG. 23 is a perspective view showing principally rear portions thereof, but with the locking components unlocked.
Figure 24:
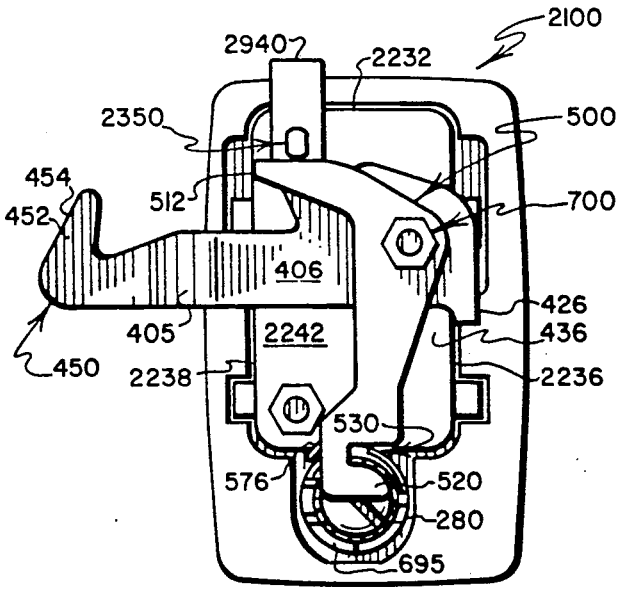
FIG. 24 is a rear elevational view similar to FIG. 21, but with the locking components unlocked.

As is best seen in FIG. 19, the handle operated arm or projection 2350 has a shoulder 2930 formed thereon at a location spaced slightly below the opening in the back wall 2242 so that, when a guide member 2940 is installed on the projection 2350 in a press-fit, the guide member 2940 will rest against the shoulder 2930 and not clamp against the back wall 2242 in away that will inhibit movement of the handle relative to the housing 2200. Preferably, the connection between the handle projection 2350 and the guide member 2940 is secured as by adhesive bonding, whereby the handle operated arm 2350 is every bit as suited as the handle operated arms 350, 1350 to pivot the arm 500 in response to handle movement.

The operating arms 500 that are utilized in the lock embodiments 100 and 1100 have leg portions 512 that are engaged by the handle-connected members 372, 1372. Likewise, the operating arm 500 that is utilized in the lock embodiment 2100 has a leg portion 512 that is engaged by a handle-connected formation 2350. Thus, the operating arms 500 all are caused to pivot about their associated mounting posts 700 as by movement of handle-connected members or formations 372, 1372 and 2350.

The lock mechanisms 600 serve to engage the hook shaped end regions 520 to selectively permit and prevent movement of the arms 500 in response to attempted operation of the handles 300, 1300 and 2300. Referring to FIG. 2, the lock mechanisms 600 include a ring-like insert 610 that is provided for positioning in the rear end region 292 of the sleeve portion 280 of the housing 200. The insert 610 serves the function of closing rear end regions of the top and bottom grooves 288 and of defining a rearwardly extending stop projection 620 for limiting the range of rotary movement of locking members 630.

In order to provide an extension of the rounded installation groove 294 through the ring-like insert 610, a rounded groove 624 is formed in the insert 610 and is aligned with the rounded groove 294 of the sleeve members 280. In order to properly position the ring-like insert 610 for mounting on the housings 200, 1200, 2200, a pair of radially extending formations 626, 628 are provided to engage the grooves 296, 298 that are formed at the rear end of the sleeve member 280. The groove 626 and the formation 296 is of relatively small size and is configured to mate in a close slip fit. The groove 628 and the formation 298 is of relatively larger size and is configured to mate in a close slip fit.

Referring to FIGS. 2, 11 and 19, a key receiving, tumbler-carrying plug assembly 650 is provided that has an enlarged diameter head portion 652 that has a circumferentially extending groove for carrying an O-ring 653, and a smaller diameter body 654 that are configured to be rotatably received in the openings and passages 282, 284. Radially extensible tumblers 656 form components of the plug 650 assembly and are extensible into the top and bottom groove 288 to selectively permit and prevent rotation of the key cylinder assembly 650 with respect to the housings 200, 1200, 2200.

The key cylinder assembly 650 has a rearwardly projecting square drive formation 678 that is engaged by a rotary locking member 680. The rotary locking member 680 is rigidly attached to the cylinder assembly by means of a threaded fastener 682 and a lock washer 684. The locking member 680 has a rearwardly extending projection 695 of curved shape that can be rotated by the key cylinder assembly 650 into and out of locking engagement with the hook shaped end region 520 of the arm 510. The rearwardly extending projection 620 of the insert ring 610 limits the range of rotary travel of the locking member 680 so as to prevent full 360 degree rotation thereof. The rearwardly extending projection 695 of the locking member 680 is rotatable 1) into locking engagement with the hook shaped end region 520 of the operating arm 510 out of locking engagement therewith to permit pivotal movement of the arm 510 by the handles 300, 1300, 2300 to retract (i.e., "unlatch") the latch bolt 400.

A locked orientation of the locking mechanism components as described above is presented in an exploded display in FIG. 29 and is designated by the numeral 790. An unlocked orientation of these components is designated by the numeral 792.

If desired, the key locking cylinder assembly 650 can be replaced by tool operated plugs, as designated by numerals 800, 810 in FIG. 29. Detent devices 802, 812 are preferably provided in the plugs 800, 810 as by forming radially extending bores 804, 814 that house springs 806, 816 and balls 808, 818 which cooperate with such interior sleeve formations as the grooves 788 that are shown in FIG. 29 to releasably retain the plugs 800, 810 in position to prevent undesired rotation thereof.

The plugs 800, 810 carry tool receiving formations, typically a hex 820 recess for receiving an Allen wrench, or a narrow, shallow slot 822 for receiving a screwdriver.

Operation of the locks 100, 1100, 2100 described herein to pivot the latch bolts 400 in "unlatching" movements will be understood by those skilled in the art to involve a simple movement of their operating handles 300, 1300, 2300 when their locking mechanisms 600 are unlocked, whereby their operating arm 510 will pivot to effect latch bolt "unlatching." And, because latch bolt "unlatching" movement is not directly tied to operating arm movement, the described locks and latches have a "slam" capability that enables the latch bolts 400 to be moved into latching engagement with strikers without causing corresponding handle movements.

To the extent that orientation terms such as "frontwardly," "rearwardly," "upwardly," "downwardly" and the like have been used in this document, it will be understood that such terms have been used simply for convenience and to facilitate understanding of the features that have been described, whereby the use of such orientation term should not be deemed to limit the scope of the claims that follow.

Although the invention has been described in its preferred form with a certain degree of particularity, it will be understood that the present disclosure of the preferred form has been made only by way of example, and that numerous changes in the details of construction and the combination and arrangements of parts and the like may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable latch, comprising:

a) housing means including a pan-shaped housing having a front wall, and having recess-defining wall formations that define a forwardly facing recess, with portions of the front wall forming a mounting flange that surrounds the recess;

b) the housing being formed as a rigid, one-piece molded structure, with the recess-defining wall formations including a substantially continuous sidewall that extends perimetrically about a back wall that is located at the rear of the recess, and with the back wall defining a rearwardly facing mounting surface that extends between first and second opposed portions of the sidewall;

c) fastener means rigidly connected to the back wall, including first and second post-like fasteners that are rigidly, connected to the back wall at first and second spaced locations near the first and second opposed portions of the sidewall, with the first and second post-like fasteners extending rearwardly from the mounting surface along a first axis and a second axis, respectively;

d) handle means including a handle that resides in the recess, that is connected to the housing, and that is movable relative to the housing between a normal, non-operated position and an operated position;

e) opening means formed through the recess-defining wall formations of the housing to establish a path of communication between the forwardly facing recess and a region that is located behind the back wall;

f) handle-connected means extending through the opening means and along said path of communication for connecting to the handle to a part of the handle-connected means that resides in said region located behind the back wall and that moves within said region along a first path of travel in response to movement of the handle between its non-operated and operated positions;

g) latch bolt means including an elongate latch bolt having a central region that extends between a first end region and a second end region, with the first end region being pivotally connected to the first post-like fastener for mounting the latch bolt on the housing for pivotal movement about said first axis, with the central region extending in a side-to-side direction across a portion of the back wall and having first portions thereof that extend beyond said first opposed portion of the sidewall for joining with the second end region, and with the second end region defining a hook-shaped formation for releasably latchingly engaging a suitably configured striker formation, whereby the latch bolt is pivotally movable relative to the housing as by pivoting the latch bolt about said first axis to move selected portions of the central region along a second path of travel as the latch bolt is moved between a latched position and an unlatched position;

h) operating means including:

i) an operating arm that has an elongate portion, with mounting formation means provided thereon for pivotally connecting the operating arm to said first post-like fastener for mounting the operating arm on the housing for pivotal movement about said first axis, and with drive formation means provided thereon at a location that is spaced from the location of the mounting formation means, whereby the drive formation means is caused to move about said first axis as the operating arm is pivoted about said first axis;

ii) said drive formation means including structure that is positioned along both of the first and second paths of travel for:

A) being interposed between the handle-connected means and the latch bolt means so as to transmit driving force directly from the handle-connected means through said structure to the latch bolt means so as to effect movement of the latch bolt means from its latched position to its unlatched position in response to movement of the handle from its non-operated position to its operated position; and, B) being positioned by the operating arm at one end of said second path of travel when the operating arm is in its normal position so as to normally not obstruct said second path of travel and to thereby permit pivotal movement of the latch bolt means about said first axis as may be needed to enable the hook-shaped end region of the latch bolt to be "slammed" into latching engagement with said suitably configured striker formation but without causing movement of the operating arm that would, in turn, cause the handle means to move out of its non-operated position as the hook-shaped end region is "slammed" into latching engagement with said striker formation; and, i) biasing means interposed between the latch bolt and the housing for biasing the latch bolt about the first axis in a direction extending away from the unlatched position toward the latched position.

2. The latch of claim 1 wherein first stop formation means is carried on and is rigidly connected to said first portions of the latch bolt, with the first stop formation means being configured to engage said first opposed portion of the sidewall when the latch bolt is pivoted to its unlatched position, whereby the engagement of the first stop formation means with said first opposed portion of the sidewall is operable to limit the range of pivotal movement that can be executed by the latch bolt as the latch bolt is pivoted about the first axis in a direction extending from the latched position toward the unlatched position.

3. The latch of claim 2 wherein:

a) the first end region of the latch bolt has second portions that extend beyond said second opposed portion of the sidewall; and, b) second stop formation means is carried on and is rigidly connected to said second portions of the latch bolt, with the second stop formation means being configured to engage said second opposed portion of the sidewall when the latch bolt is pivoted to its latched position, whereby the engagement of the second stop formation means with said second opposed portion of the sidewall is operable to limit the range of pivotal movement that can be executed by the latch bolt as the latch bolt is pivoted about the first axis in a direction extending from the unlatched position toward the latched position.

4. The latch of claim 1 wherein:

a) sleeve-like formation means is defined by the operating arm, including a sleeve-like formation that has a relatively cylindrical outer configuration that defines a substantially constant outer diameter, and with the sleeve-like formation having a coaxially-extending hole formed therethrough, with the hole being positioned to surround portions of the first post-like fastener so as to mount the operating arm for pivotal movement about the first axis of the first post-like fastener; and, b) the first end region of the latch bolt has a hole formed therethrough, with the diameter of thereof being selected to provide a slip fit that receives the outer diameter of the sleeve-like formation so as to mount the latch bolt for pivotal movement about the first axis, with relative movement between the latch bolt and the operating arm being permitted thereby.

5. The latch of claim 4 wherein:

a) the biasing means that is interposed between the latch bolt and the housing for biasing the latch bolt about the first axis in a direction extending away from the unlatched position toward the latched position includes a torsion coil spring formed from a length of spring steel wire, with first and second end segments thereof projecting from opposite ends of a coiled central segment thereof, with the coiled central segment being positioned to extend about the outer diameter of the sleeve-like formation;

b) a cut-out region is defined by the latch bolt for receiving the first end segment and the coiled central segment to thereby enable the coiled central segment to extend about said sleeve-like formation, and to provide a means for securely drivingly connecting the first end segment of the torsion coil spring to the latch bolt; and, c) the second end segment of the torsion coil spring extends into seated engagement with a portion of the housing;

d) whereby the torsion coil spring is securely connected to the housing and to the latch bolt and serves to bias the latch bolt relative to the housing in a direction that extends away from the unlatched position of the latch bolt and toward the latched position of the latch bolt.

6. The latch of claim 1 wherein:

a) the operating arm is of L-shaped configuration and has a central portion and a pair of first and second leg portions, with the first leg portion and the second leg portion extending in different directions across the back wall from the central portion so as to give the operating arm a generally "L-shaped" configuration;

b) the central portion defines said mounting portion such that the L-shaped operating arm has its central portion pivotally connected to said first post-like fastener for mounting the L-shaped operating arm on the housing for pivotal movement about said first axis; and, c) the first leg portion defines said drive formation means that is positioned to intercept both the first path of travel and the second path of travel when the operating arm is pivoted about the first axis between a normal position and an operating position.

7. The latch of claim 6 wherein:

a) the second leg portion has a selected part thereof that moves along a third path of travel as the L-shaped operating arm is pivoted between its normal position and its operating position; and, b) locking means is connected to the housing and includes a locking member that is movable into and out of said third path of travel for selectively permitting and preventing pivotal movement of the operating arm out of its normal position.

8. The latch of claim 7 wherein the second post-like fastener is located in close proximity to one end of the third path of travel such that, when the operating arm is in its normal position, the selected part is positioned in close proximity to the second post-like fastener, and said movable locking member cooperates with the second post-like fastener to confine the selected part therebetween.

9. The latch of claim 7 wherein the selected part of the second leg portion includes a hook-shaped formation that defines a notch, and said movable locking member is received within said notch when the locking member is position to prevent pivotal movement of the operating arm out of its normal position.

10. The latch of claim 1 wherein the front wall has a front surface that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

11. The latch of claim 10 wherein the handle is formed as a rigid, one piece molded structure, the handle has a front wall that has a front surface, and the front surface of the handle is configured to extend contiguously with front surface portions of the housing when the handle is in its non-operated position.

12. The latch of claim 11 wherein the housing and the handle are formed from an injection molded, glass reinforced, polycarbonate based polymer blend thermoplastics material.

13. The latch of claim 1, wherein:

a) the opening means includes at least one hole formed through recess-defining wall formations extend between the front and back walls; and, b) the handle-connected means includes an elongate element that extends through the at least one hole, is journaled by the housing for pivotal movement relative thereto, and is rigidly connected to the handle for pivotally connecting the handle to the housing for movement between its non-operated and operated positions.

14. The latch of claim 13 wherein the handle has stop formation means thereon for defining the non-operated position of the handle as by engaging the back wall of the housing.

15. The latch of claim 1, wherein:

a) the opening means includes an elongate slot that is formed in the back wall; and, b) the handle-connected means includes a projection that extends rearwardly from the handle and through the elongate slot for engaging said one leg of the L-shaped operating arm to establish a driving connection between the handle and the operating arm.

16. The latch of claim 15 wherein the handle is slidably mounted on the housing, and retaining means is provided for connection with the rearwardly extending projection at a location behind the back wall to retain the handle nested within the recess.

17. The latch of claim 1 wherein:

a) the first and second post-like fasteners have thread formations;

b) U-shaped mounting bracket means including a U-shaped mounting bracket having an elongate central part and two leg parts that extend forwardly from opposite end regions is provided for mounting other components of the latch on a closure or the like;

c) a pair of holes are formed through the central part in alignment with the first and second axes that are defined by first and second post-like fasteners; and, d) auxiliary fasteners having thread formations that are configured to establish threaded connections with the thread formations of the post-like fasteners are provided so that selected ones of the thread formations can be extended through the pair of holes and said threaded connections can be established to securely connect said mounting bracket to other components of the latch.

18. The latch of claim 1 wherein:

a) each of the post-like mounting means includes an elongate tubular sleeve-defining structure that is internally threaded and defines a rearwardly facing threaded opening;

b) mounting bracket means is provided for overlying rearward portions of the latch including the sleeve-defining structures, and for extending into engagement with a rearward surface of a structure onto which the latch is to be mounted; and, c) auxiliary threaded fastener means is provided for being threaded into the rearwardly end regions of the threaded openings for connecting the mounting bracket means to the elongate tubular sleeve means.

19. The latch of claim 1 wherein the biasing means is a torsion coil spring that is adequately strong as regards the force that it exerts in biasing the latch bolt toward its latched position to cause the biasing action of the spring to be transmitted through the operating arm and through the handle-connected means to the handle so that the handle and the operating arm are biased toward their normal, non-operating positions to minimize rattle and to provide an essentially play-free driving connection between the handle and the latch bolt for pivoting the latch bolt in an "unlatching" movement in response to pivotal movement of the handle toward its operated position.

20. A flush-mountable latch for a closure, comprising:

a) housing means including a housing having a front wall and having wall portions that join with the front wall to define a forwardly-facing recess that opens through the front wall, with the front wall defining a mounting flange that extends perimetrically about the recess, with the housing having a back wall that has a front face that defines the rear of the recess, and that has a rear face that defines a substantially planar mounting surface that extends between wall portions that define opposed sides of the recess;

b) mounting means for extending rearwardly from the mounting surface at spaced locations thereon, including first and second generally cylindrical mounting formations that project rearwardly from the mounting surface along spaced first and second axes that extend substantially parallel to each other;

c) operating means including an L-shaped operating arm pivotally connected to one of the first mounting formation for pivotal movement relative to the housing about the first axis, and having first and second leg portions that extend away from the location of the first axis, with the first and second leg portions overlying portions of the back wall of the housing, with the first leg portion extending sidewardly between the opposed sides of the recess, with first drive formation means being defined by the first leg portion, and with the second leg portion extending substantially transversely relative to the first leg portion so as to provide an end region that overlies a selected portion of the mounting flange;

d) handle means including a handle positioned in the forwardly-facing recess and being movable relative to the housing between non-operated and operated positions;

e) opening means formed in the pan-shaped wall structure that defines the recess;

f) handle-connected means for movably connecting the handle to the housing, for extending through the opening, for defining second drive formation means for engaging the first drive formation means to drivingly connect the handle through to the operating arm for pivoting the operating arm about the first axis in response to movement of the handle from its non-operated to its operated position;

g) latch bolt means including a latch bolt that is pivotally connected to said one of the first mounting formation for pivotal movement relative to the housing about the first axis, with the latch bolt defining a hook-shaped portion located to one side of the housing for latchingly engaging a suitably configured striker formation, with the latch bolt having a portion that extends closely alongside the first leg portion of the L-shaped operating arm for defining third drive formation means for selectively engaging the first drive formation means to cooperate with the second drive means in providing a driving connection between the handle and the latch bolt for pivoting the latch bolt about the first axis from a latch ed position to an unlatched position in response to movement of the handle from its non-operated to its operated position, and for permitting disengagement of the third drive means from the first drive means so as to permit pivotal movement of the latch bolt means about the first axis as may be needed to enable the hook-shaped end region of the latch bolt to be "slammed" into latching engagement with said suitably configured striker formation; and, h) biasing means interposed between the latch bolt means and the housing means for biasing the latch bolt about the first axis in a direction extending away from the unlatched position toward the latched position.

21. The latch of claim 20 wherein stop formation means is carried on and is rigidly connected to the latch bolt for engaging at least a portion of the recess-defining wall portions to limit the range of pivotal movement of the latch bolt means about the first axis.

22. The latch of claim 20 wherein:

a) sleeve-like formation means is defined by the operating arm, including a sleeve-like formation that has a relatively cylindrical outer configuration that defines a substantially constant outer diameter, and with the sleeve-like formation having a coaxially-extending hole formed therethrough, with the hole being positioned to surround the cylindrical mounting formation of the first mounting means so as to mount the operating arm for pivotal movement about the first axis; and b) the latch bolt has a hole formed therethrough, with the diameter thereof being selected to provide a slip fit that receives the outer diameter of the sleeve-like formation so as to mount the latch bolt for pivotal movement about the first axis, with relative movement between the latch bolt and the operating arm being permitted thereby.

23. The latch of claim 22 wherein:

a) the biasing means that is interposed between the latch bolt and the housing for biasing the latch bolt about the first axis in a direction extending away from the unlatched position toward the latched position includes a torsion coil spring formed from a length of spring steel wire, with first and second end segments thereof projecting from opposite ends of a coiled central segment thereof, with the coiled central segment being positioned to extend about the outer diameter of the sleeve-like formation;

b) a cut-out region is defined by the latch bolt for receiving the first end segment and the coiled central segment to thereby enable the coiled central segment to extend about said sleeve-like formation. and to provide a means for securely drivingly connecting the first end segment of the torsion coil spring to the latch bolt; and, c) the second end segment of the torsion coil spring extends into seated engagement with a portion of the housing;

d) whereby the torsion coil spring is securely connected to the housing and to the latch bolt and serves to bias the latch bolt relative to the housing in a direction that extends away from the unlatched position of the latch bolt and toward the latched position of the latch bolt.

24. The latch of claim 20 wherein locking means is connected to the selected portion of the mounting flange and includes a locking member that is movable into and out of a path of travel that is followed by said end region of the second leg portion as the operating arm is pivoted between its non-operating and its operating positions, with the locking member being operable to selectively permit and prevent movement of the operating arm out of its non-operating position so as to selectively "lock" the operating arm from being moved to effect unlatching movement of the latch bolt.

25. The latch of claim 24 wherein said end region includes a hook-shaped formation that defines a notch, and said movable locking member is received within said notch when the locking member is positioned to prevent pivotal movement of the operating arm out of its non-operating position.

26. The latch of claim 20, wherein:

a) the opening means includes an elongate slot that is formed in the back wall; and, b) the handle-connected means includes a projection that extends rearwardly from the handle through the elongate slot for defining said second drive formation means.

27. The latch of claim 20 wherein:

a) the opening means includes at least one hole formed through a side wall portion that defines one of the opposed sides of the recess; and, b) the handle-connected means includes structure that extends from the handle through the opening and thence rearwardly so as to define said second drive formation means.

28. The latch of claim 20 wherein the biasing means is a torsion coil spring that is adequately strong as regards the force that it exerts in biasing the latch bolt toward its latched position to cause the biasing action of the spring to be transmitted through the operating arm and through the handle-connected means to the handle so that the handle and the operating arm are biased toward their normal, non-operating positions to minimize rattle and to provide an essentially play-free driving connection between the handle and the latch bolt for pivoting the latch bolt in an "unlatching" movement in response to pivotal movement of the handle toward its operated position.

* * * * *